US010251808B1

(12) United States Patent
Theis

(10) Patent No.: US 10,251,808 B1
(45) Date of Patent: Apr. 9, 2019

(54) CONFIGURABLE CUSHION ASSEMBLY

(71) Applicant: Deanna Theis, Dallas, TX (US)

(72) Inventor: Deanna Theis, Dallas, TX (US)

( * ) Notice: Subject to any disclaimer, the term of this patent is extended or adjusted under 35 U.S.C. 154(b) by 186 days.

(21) Appl. No.: 15/367,083

(22) Filed: Dec. 1, 2016

Related U.S. Application Data

(60) Provisional application No. 62/261,527, filed on Dec. 1, 2015, provisional application No. 62/419,966, filed on Nov. 9, 2016.

(51) Int. Cl.
*A61H 19/00* (2006.01)
*A47G 9/10* (2006.01)

(52) U.S. Cl.
CPC ..... *A61H 19/44* (2013.01); *A47G 9/1045* (2013.01); *A47G 9/1072* (2013.01); *A47G 2009/1018* (2013.01); *A61H 2201/0134* (2013.01)

(58) Field of Classification Search
CPC . A47C 15/008; A47G 2009/002; Y10S 5/929; A61H 19/50; A61H 19/44
USPC ..... 600/38
See application file for complete search history.

(56) References Cited

U.S. PATENT DOCUMENTS

| | | | | |
|---|---|---|---|---|
| 2,667,915 | A * | 2/1954 | Pfeffer | A47G 9/10 5/487 |
| 3,761,131 | A * | 9/1973 | Oliver | A47C 7/18 297/452.16 |
| 5,572,757 | A * | 11/1996 | O'Sullivan | A47C 7/46 297/284.5 |
| 6,038,719 | A * | 3/2000 | Castagna | A47G 9/1045 5/636 |
| 7,993,262 | B2 * | 8/2011 | Cianfrani | A61H 19/34 600/38 |
| 8,968,183 | B2 * | 3/2015 | Hamilton | A61H 19/00 128/845 |
| 9,204,720 | B2 * | 12/2015 | Gagnon | A47C 3/16 |
| 2006/0084933 | A1 * | 4/2006 | Aellis | A61H 19/44 604/342 |
| 2007/0214572 | A1 * | 9/2007 | Buben | A61H 19/00 5/630 |
| 2009/0188047 | A1 * | 7/2009 | Morse | A47C 15/008 5/655.9 |
| 2010/0191048 | A1 * | 7/2010 | Kulikov | A61H 19/00 600/38 |
| 2018/0104088 | A1 * | 4/2018 | Ishikawa | A61F 5/41 |

* cited by examiner

*Primary Examiner* — Joshua T Kennedy

(57) ABSTRACT

A configurable cushion assembly adaptable for personal pleasure activities includes multiple cushions joined in a pivoting arrangement by which multiple cushioned constructions may be adapted to aid in personal exercise or other physical activities. Various elements of the cushion assembly provide for the retention and support of personal massaging devices in a variety of configurable positions.

15 Claims, 19 Drawing Sheets

DP

FIG. 14
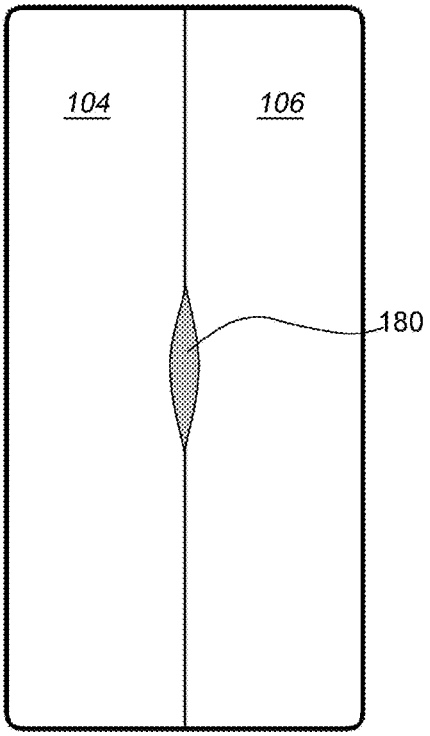
FIG. 15
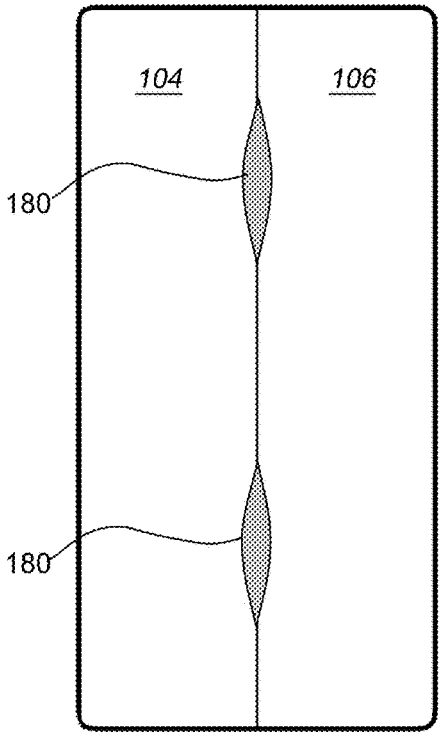
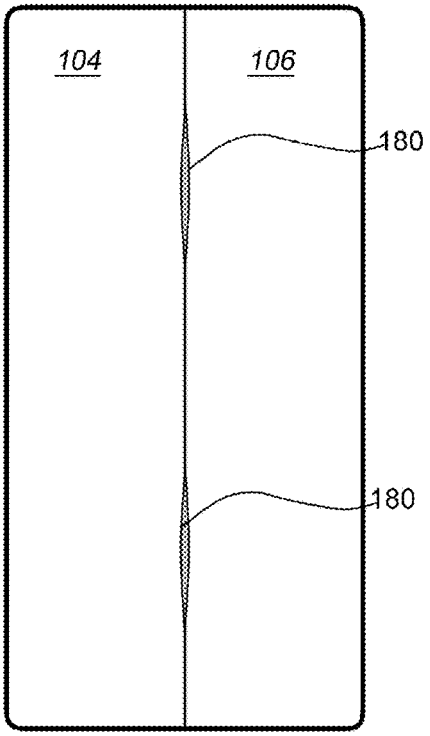
FIG. 16
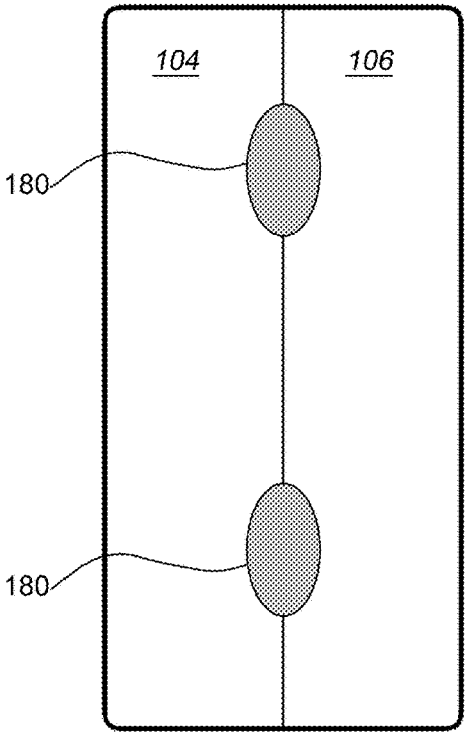
FIG. 17

FIG. 22
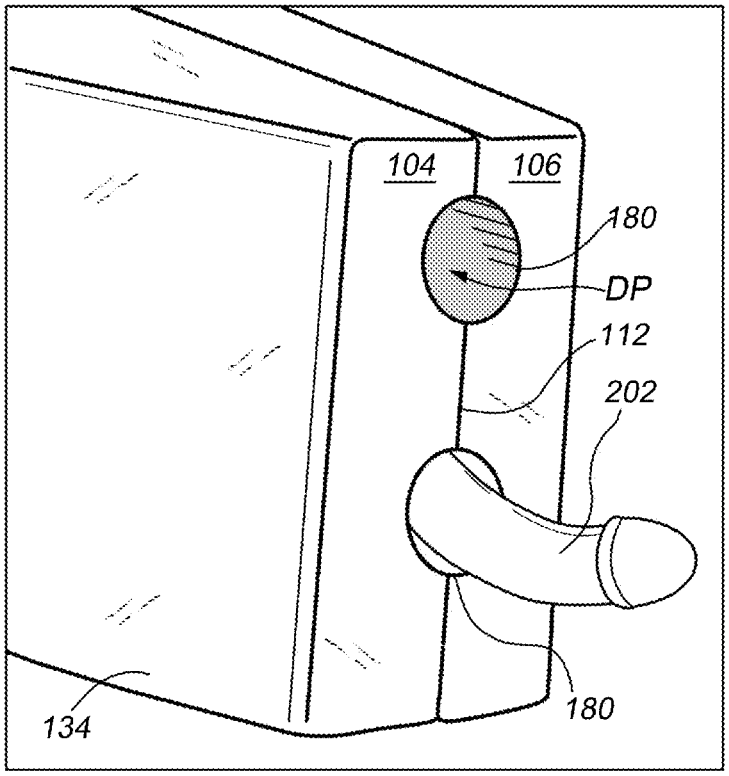
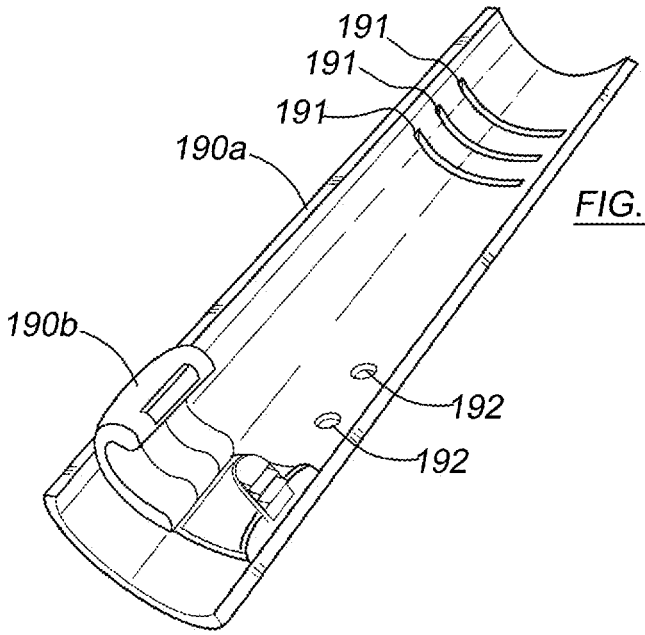
FIG. 23

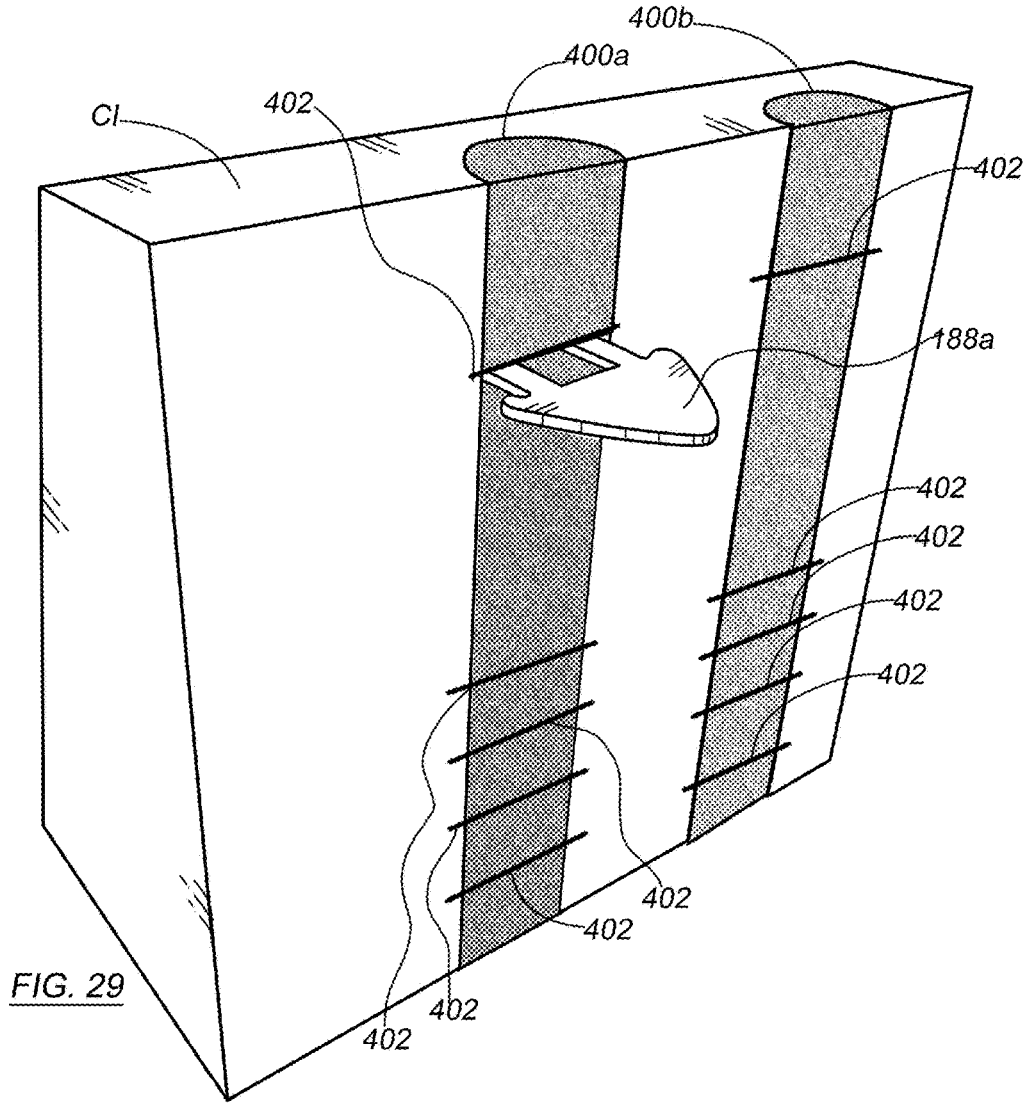
FIG. 29
FIG. 30
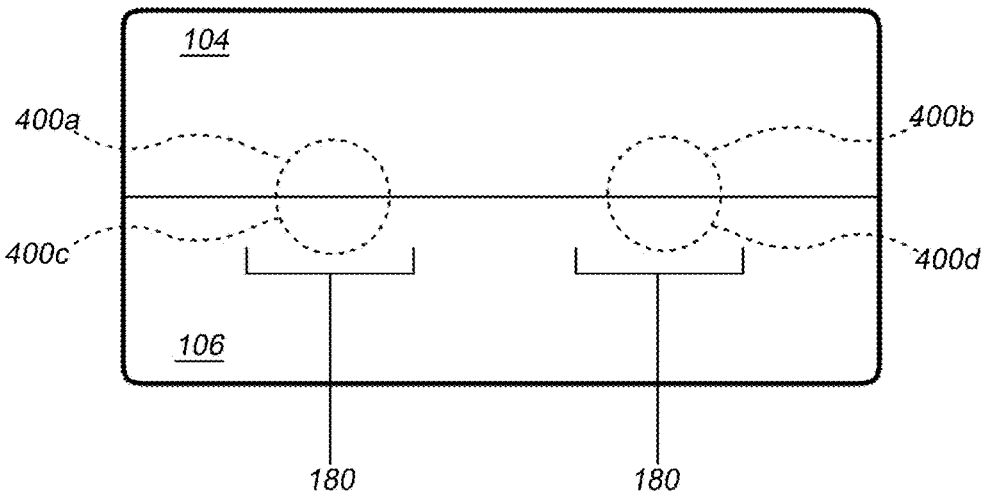

CONFIGURABLE CUSHION ASSEMBLY

CROSS REFERENCE TO RELATED APPLICATIONS

This Utility Application claims benefit of U.S. Provisional Application No. 62/261,527 Titled "Configurable Personal Pleasure Accessory and Methods of Manufacturing Same" having a filing date of 1 Dec. 2015, and, U.S. Provisional Application No. 62/419,966 Titled "Configurable Personal Pleasure Accessory and Methods of Manufacturing Same" having a filing date of 9 Nov. 2016

BACKGROUND

Field of the Disclosure

The present invention generally relates to a personal health accessory including a configurable cushion assembly, and more particularly to configurable cushion assembly configured for the support and positioning of a personal pleasure device.

Background

Some past attempts in the art to provide for a support for a personal pleasure device or personal massage device rely on retention systems that offer a limited kind of adjustment without the ability of retain a personal pleasure device in a fixed position during use. In addition, the foregoing systems, apparatus and articles of manufacture are readily ascertained upon casual inspection to be directed to sexual pleasuring. To avoid embarrassment users of such articles may feel the need to hide said articles from casual observers such as children and/or guests. Accordingly, there is a need for an apparatus that is configurable to various positions wherein a user may securely and reliably position a personal pleasure device, the apparatus facilitating hands-free use of the personal pleasure device while the user simultaneously engages in intercourse or hands-free use of the personal pleasure device during other intimate activities. Such an apparatus should be designed to withstand strenuous use by a user without the dislodging of a supported personal pleasure device. In addition, such an apparatus would advantageously have an innocuous appearance providing no indication to a casual observer of its intended use, as well as providing the ability to hide a personal pleasure device within the apparatus, thus making the apparatus and personal pleasure device readily accessible. Accordingly, the current application describes an improvement in the area of configurable personal pleasure accessories, for use with personal pleasure devices, such as massaging devices and sexual pleasure devices.

SUMMARY

In the area of personal pleasure device accessories, it is apparent that a need exists for a configurable cushion assembly capable of securely holding a personal pleasure device, such as a massage device or sexual device, while it is in use. The configurable cushion assembly is suitable for all body shapes and sizes and allows for precise fixed positioning and hands-free control of a personal pleasure device as desired and/or required by a user. The configurable cushion assembly helps the user maintain a personal pleasure or sexual device at specific heights, angles and operational states to provide for preferred positioning during use of such a device. Features of the configurable cushion assembly enable users to enjoy the present invention who would not otherwise be able to use a personal pleasure or sexual device for reasons such as medical limitations, physical limitations or disabilities; e.g., persons confined to a wheelchair or a bed, or pregnancy. The configurable cushion assembly provides a cushion that is readily configurable into various configurations that allow one or more users to securely position the massage devices or pleasure devices for personal use and pleasure in various optimal positions; whether one is standing, sitting, kneeling, laying on one's side, laying on one's back, and with or without a partner. Furthermore, the appearance of the configurable cushion assembly is pleasing in design and unobtrusive.

In accordance with one aspect of the present invention, a configurable cushion assembly is presented. Other aspects, objects and features of the present invention may include a configurable personal massaging device mount for furniture or a configurable personal massaging device holding apparatus.

BRIEF DESCRIPTION OF THE DRAWING FIGURES

For a more complete understanding of the present invention and its advantages, reference is now made to the following description and accompanying drawings, in which.

Figure 5:
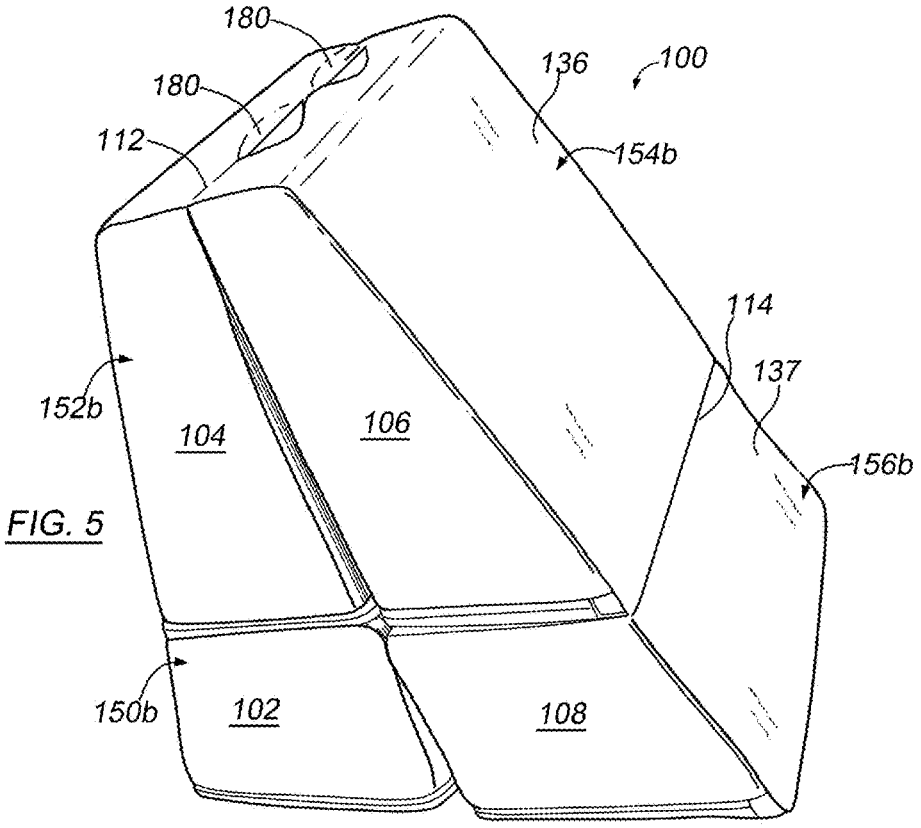
FIG. 5 is a perspective view thereof showing a fourth configuration also called a "standing configuration" wherein the cushions are configured to provide a relatively wider, stable base, and sloping sides.
Figure 13:
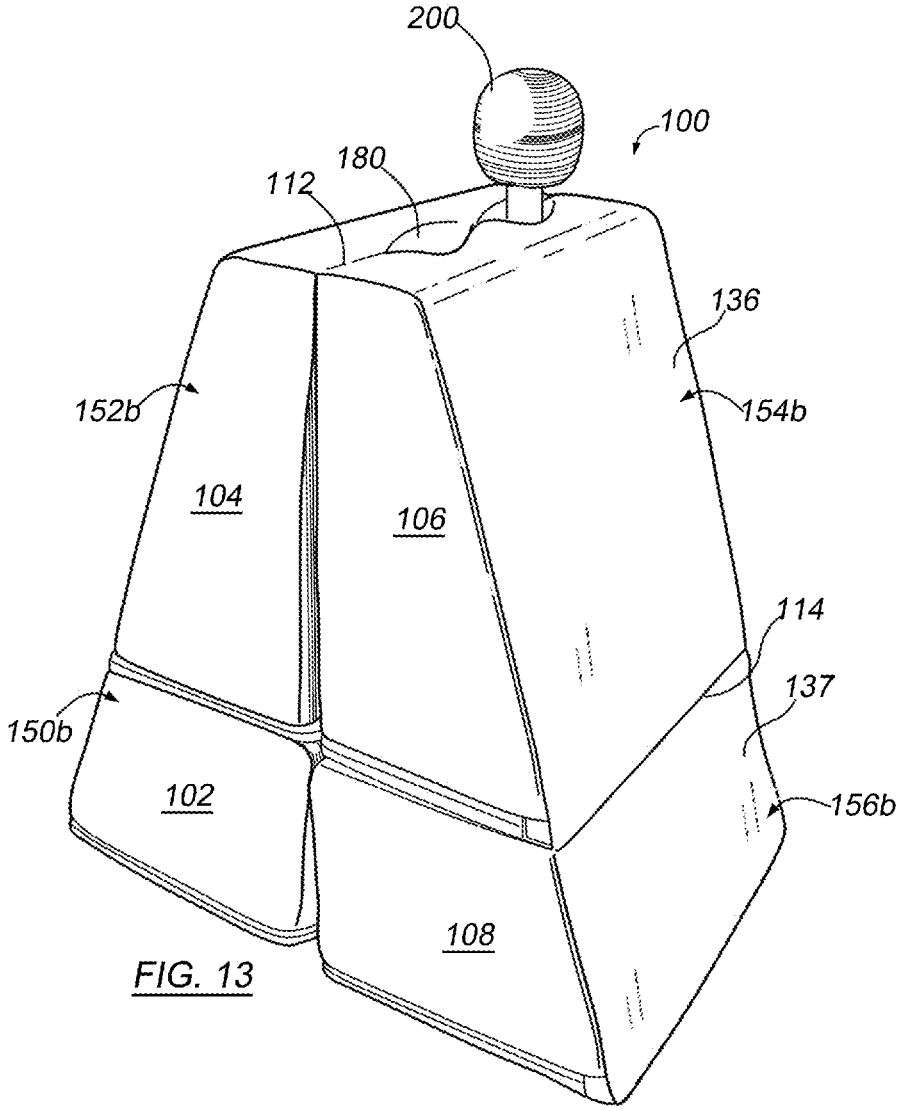
Figure 18:
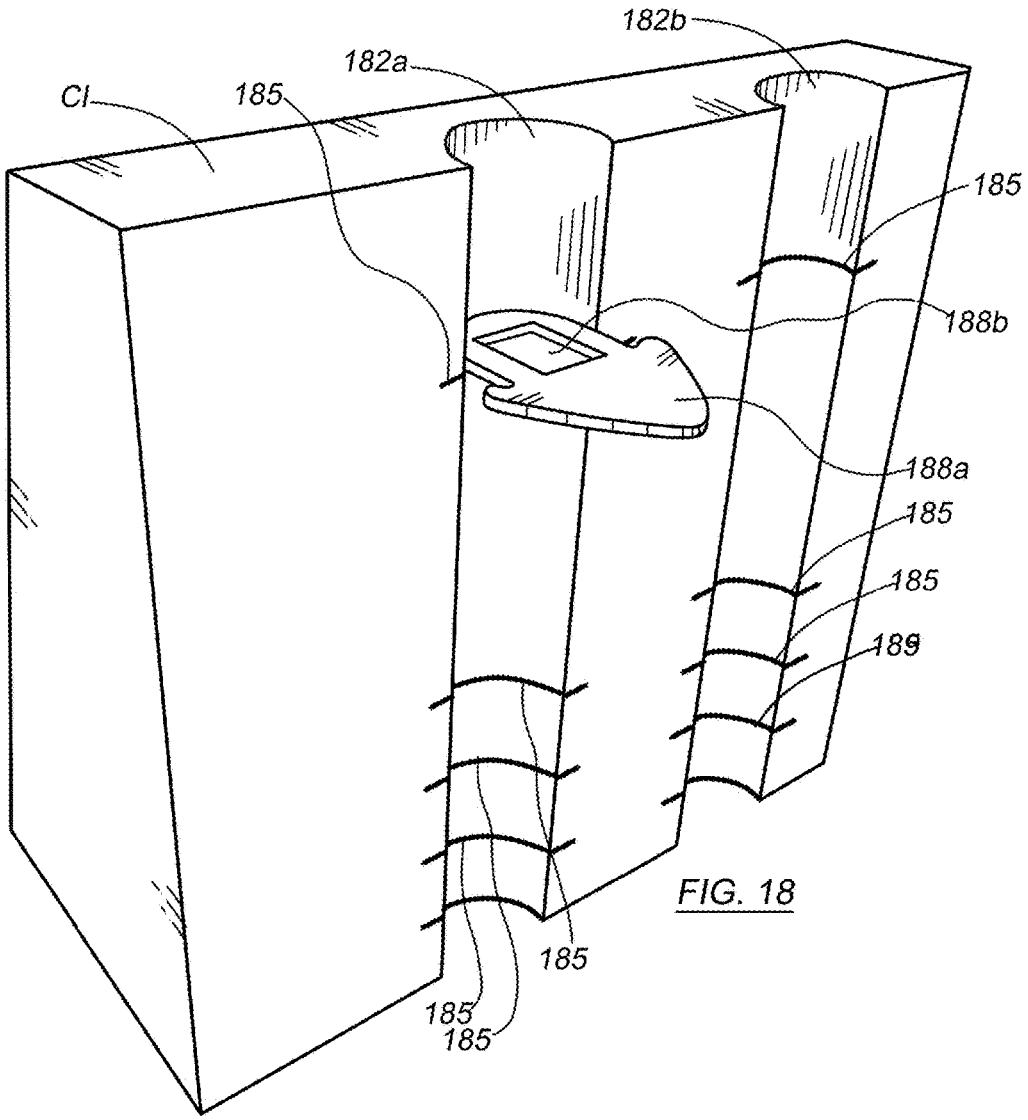
Figure 19:
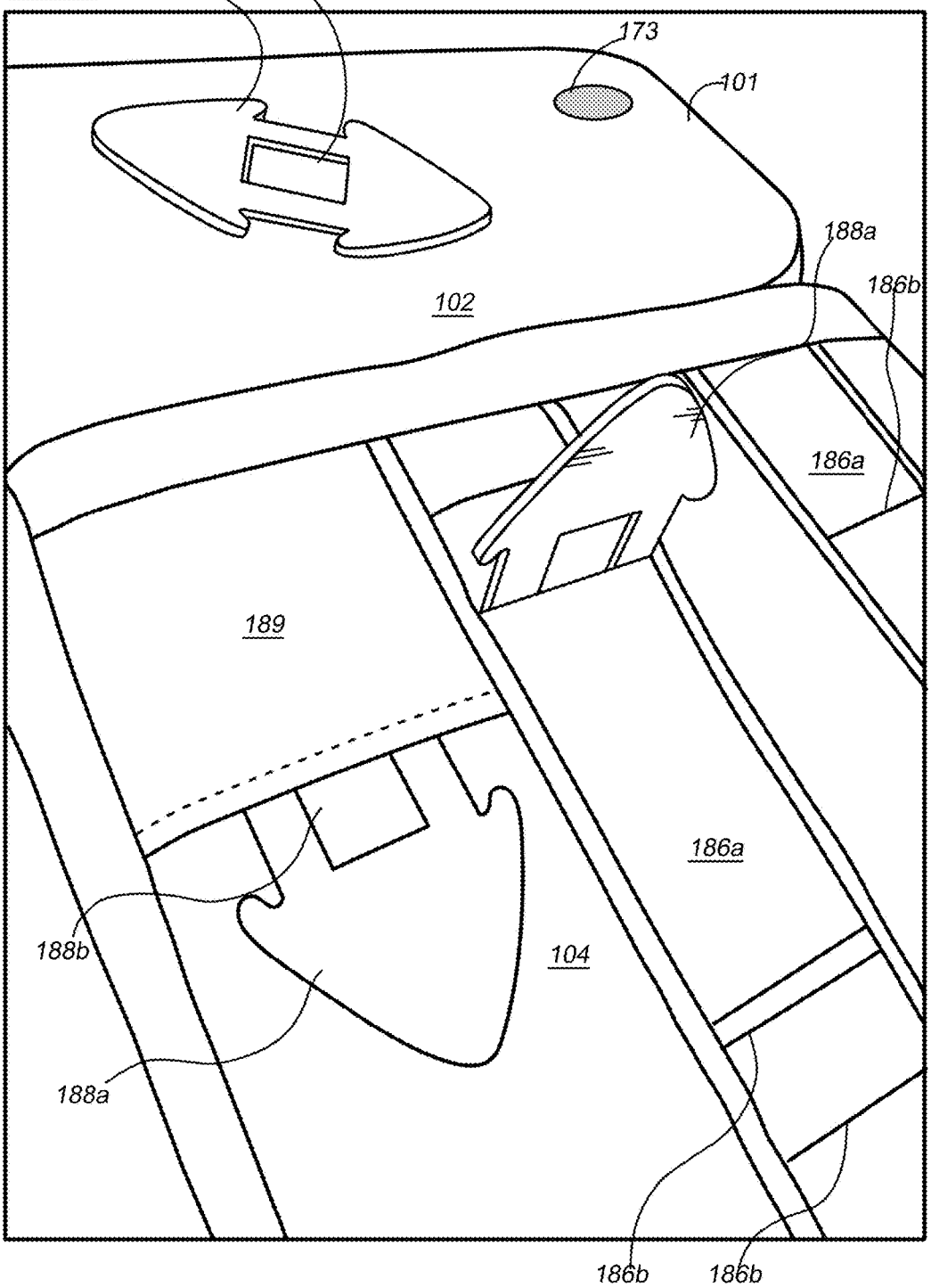
Figure 20:
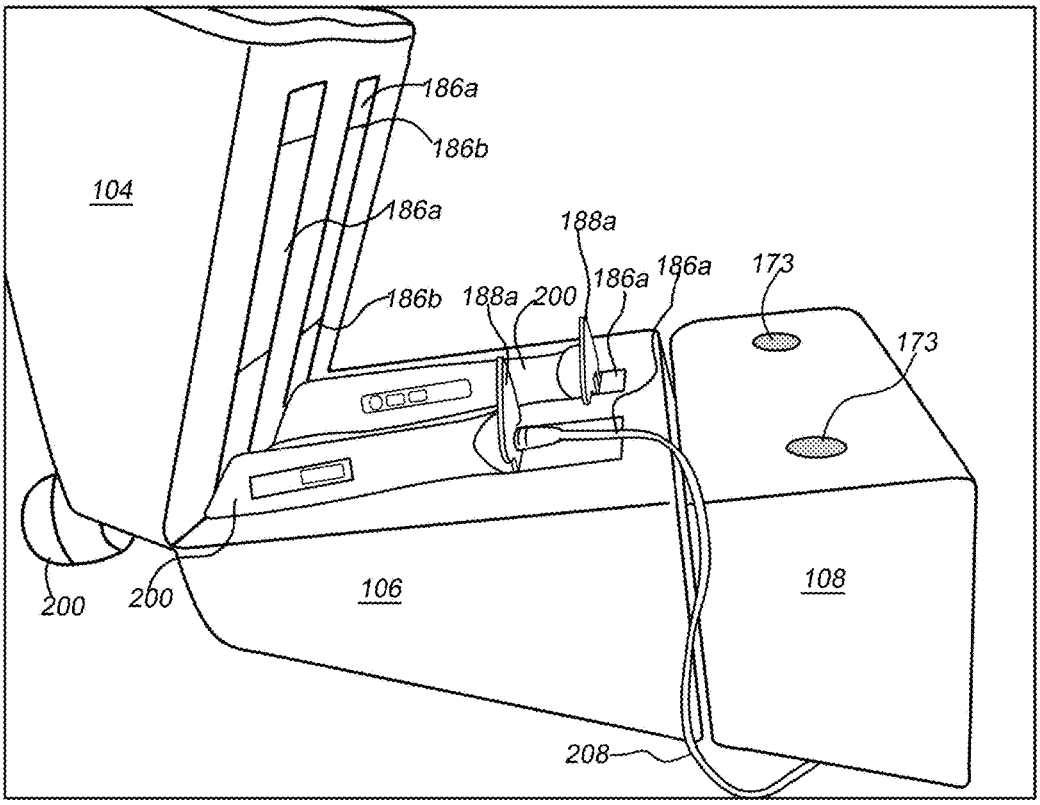

FIG. 13 shows the configuration shown in FIG. 5 with a retained personal pleasure device 200 in an upright position;

FIGS. 14-17 show various embodiments of the configurable cushion assembly with a variety of device reception openings 180 that vary in number, position and size and shape;

FIG. 18 is a perspective view of an exemplary cushion insert for one of the larger cushions 104, 106 formed with side by side docking port recesses;

FIG. 19 is an enlarged view of one side (see FIG. 3), of the configurable cushion assembly;

FIG. 20 shows an exemplary use of retention clips 188*a* placed at the end of a massage device to support the device at a desired depth relative to the docking port recesses 182*a*, 182*b*, 184*a*, 184*b*, wherein the retention clips 188*b* are configured for transverse placement by sliding the clips in the slots 188*a* situated transversely over the docking port covers 186*a;*

Figure 21:
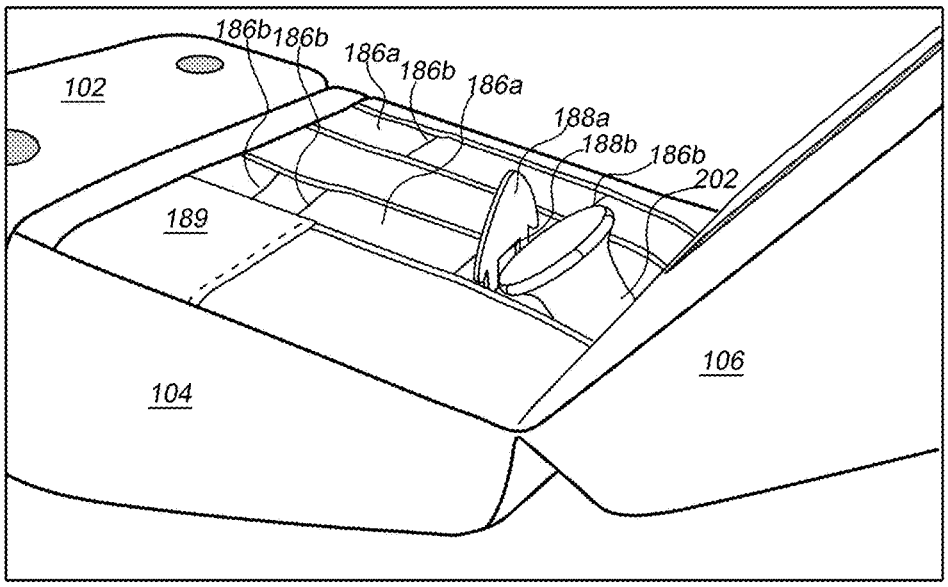
Figure 24A:
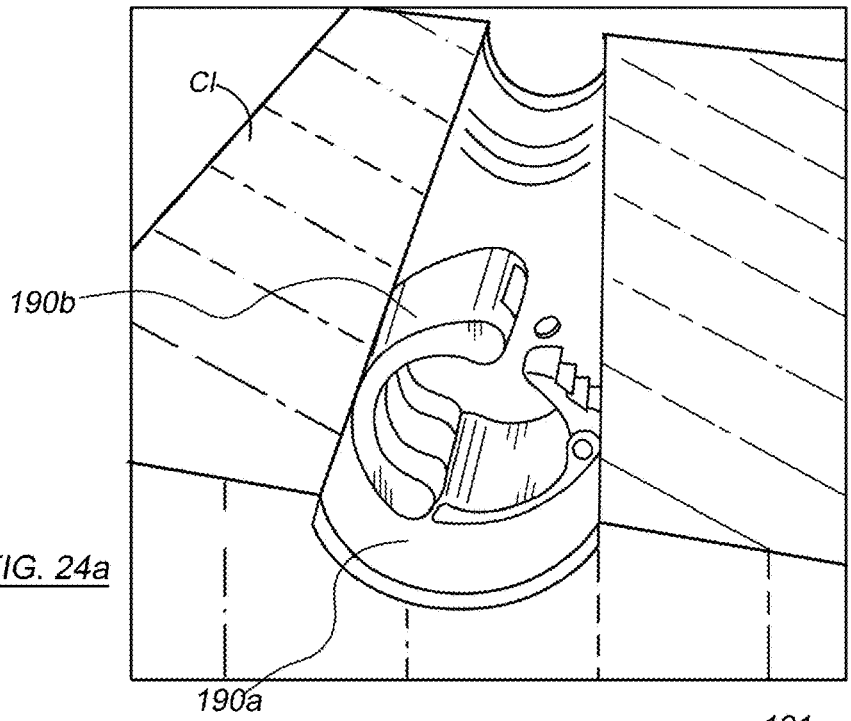
Figure 24B:
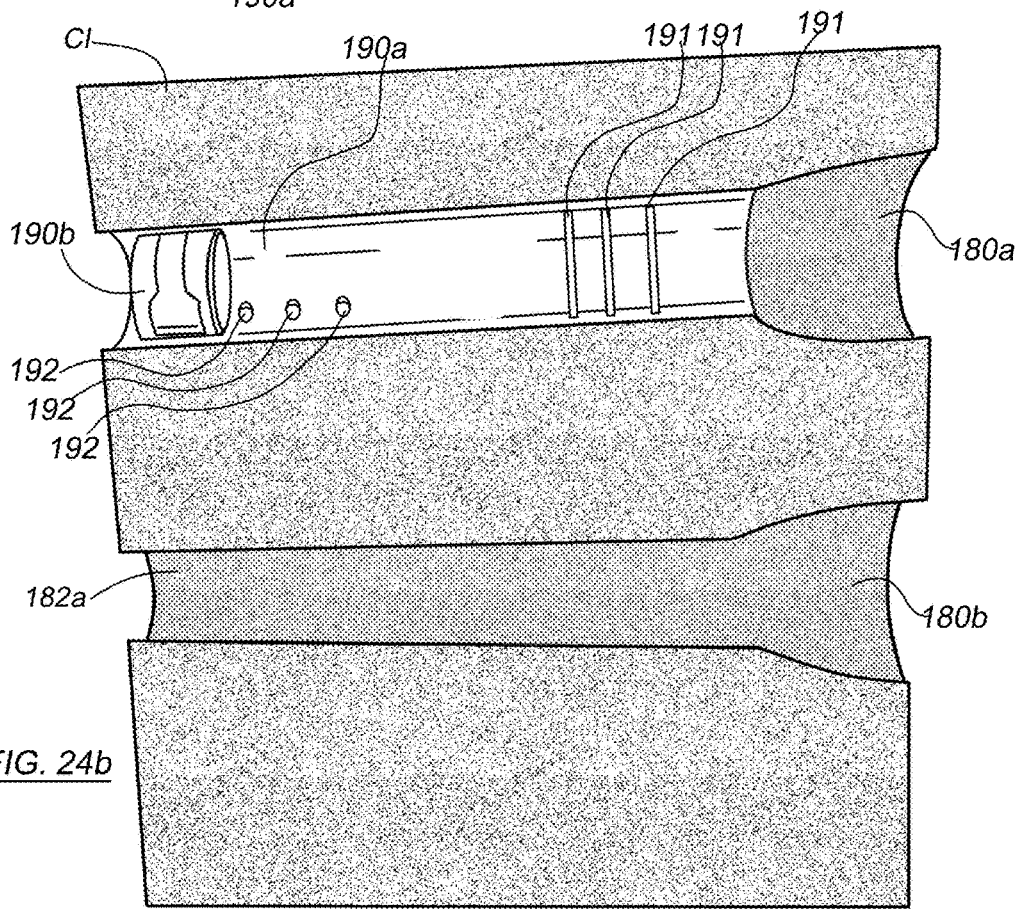
Figure 25A:
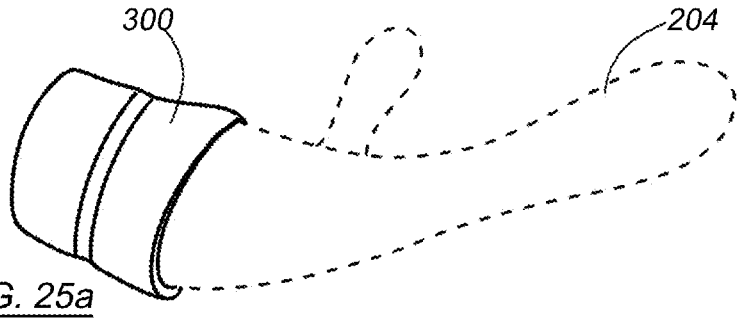
Figure 25B:
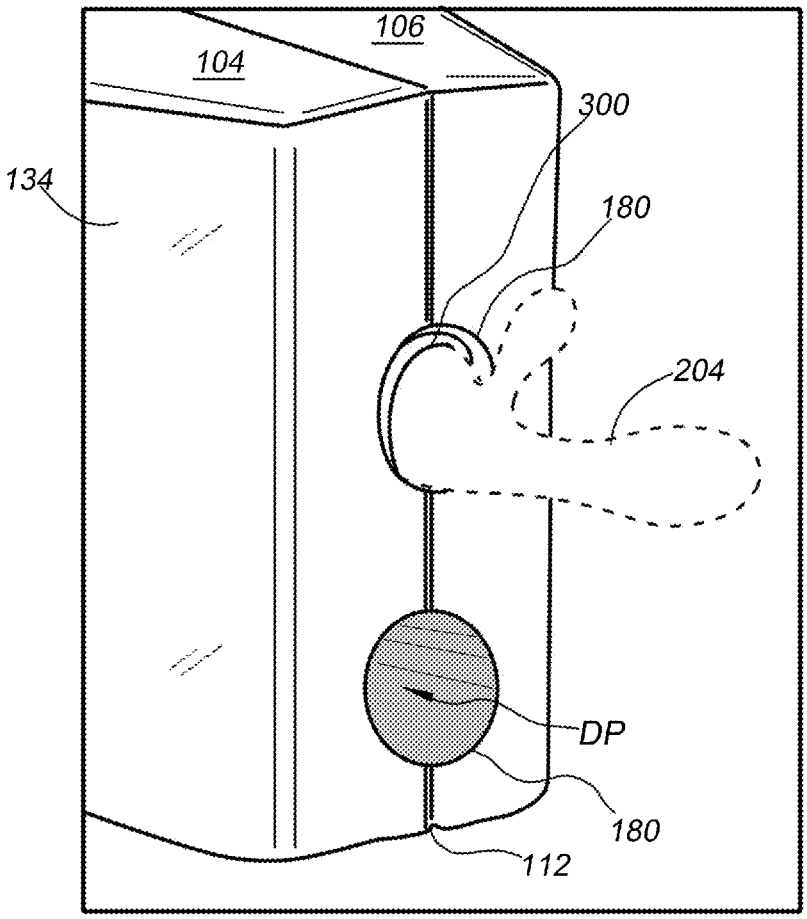
Figure 26:
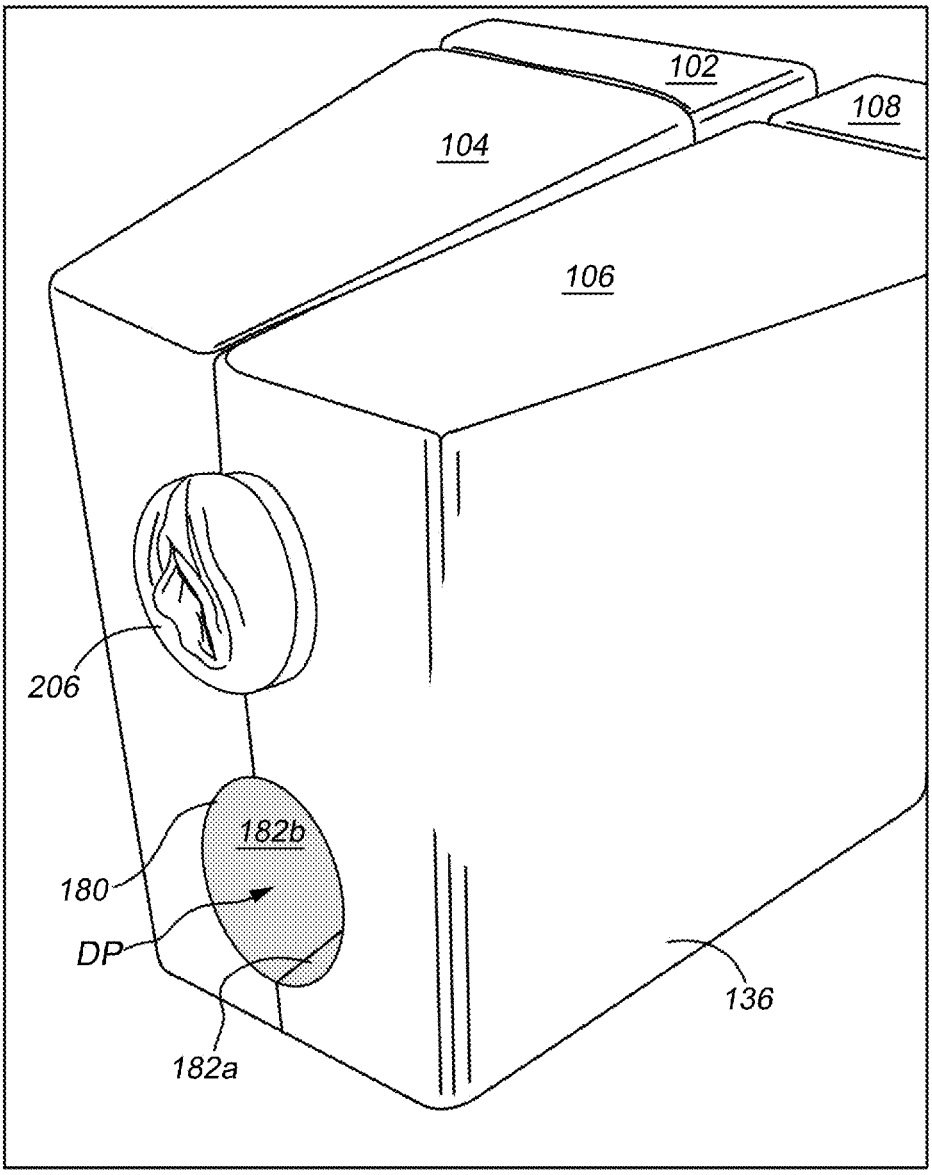
Figure 27:
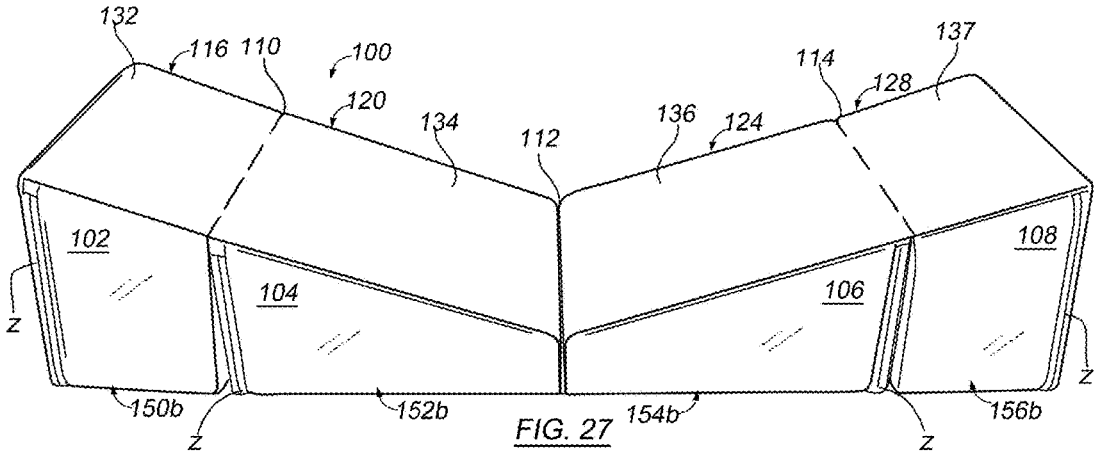
Figure 28:
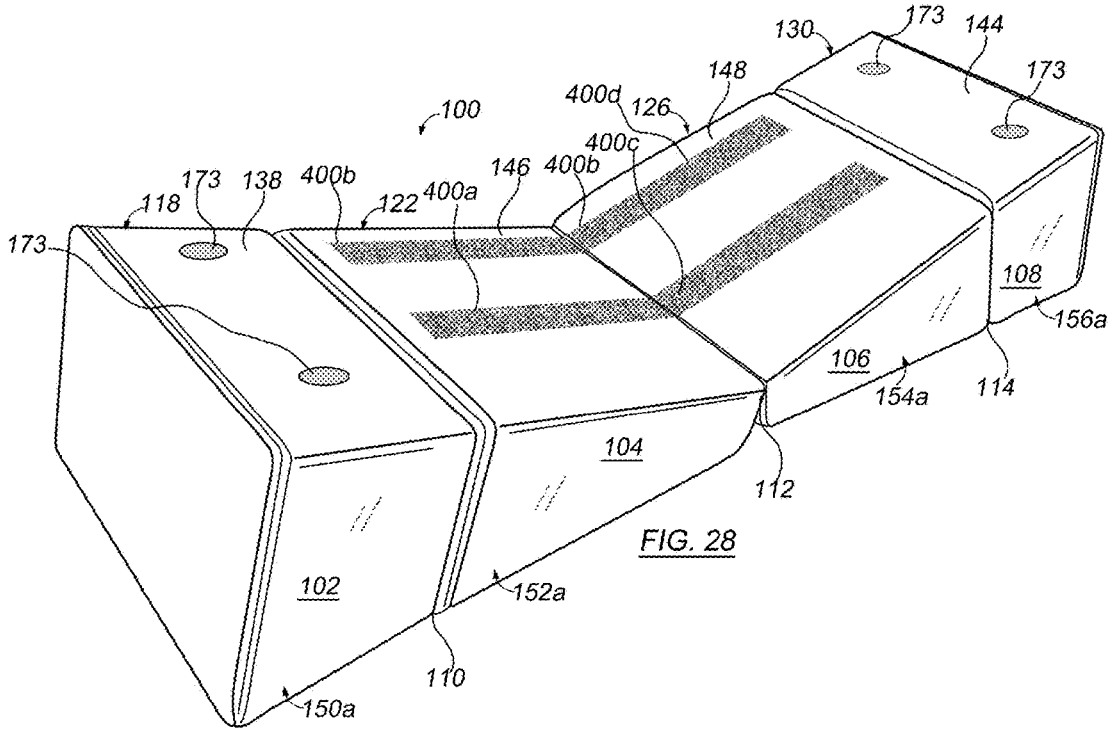
Figure 31:
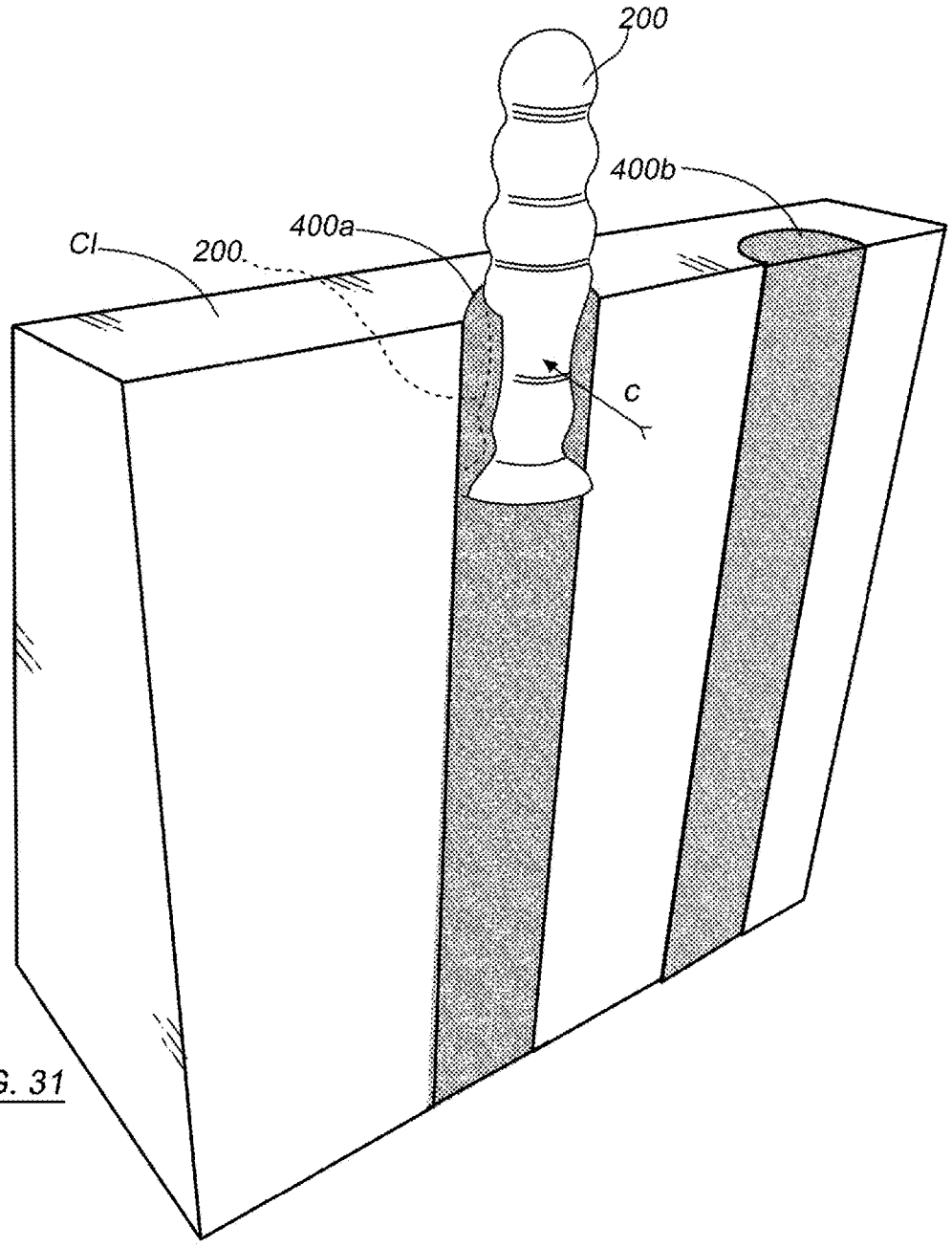
Figure 32:
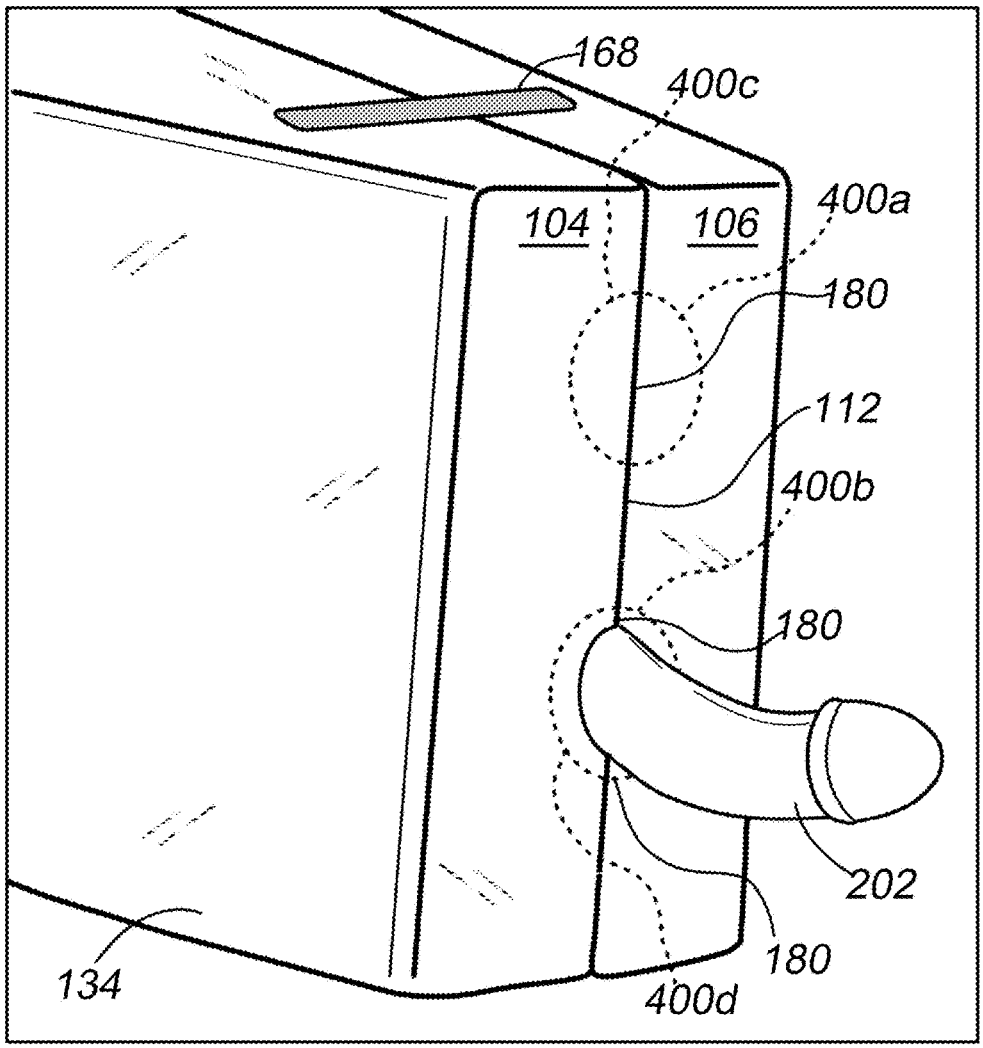

FIG. 21 shows another exemplary use of the retention clips 188*a* with a personal pleasure device 202;

FIG. 22 shows an external view of the configurable cushion assembly supporting the retained pleasure device shown in FIG. 21;

FIG. 23 shows a device retentive insert 190*a* for placement within one or more of the docking port recesses 182*a*, 182*b*, 184*a*, 184*b* of the configurable cushion assembly 100;

FIG. 24*a* is a perspective view showing the device retentive insert nested in one of the docking port recesses 182*a*, 182*b*, 184*a*, 184*b* of a foam cushion insert CI;

FIG. 24*b* is another perspective view showing the device retentive insert nested in one of the docking port recesses 182*a*, 182*b*, 184*a*, 184*b* of a foam cushion insert CI, showing a top view of the cushion insert;

FIGS. 25A-25B illustrate alternative views of a flexible mount 300 used for retention of a personal pleasure device 204 within a configurable cushion of the various disclosed embodiments of the present invention;

FIG. 26 illustrates an alternative embodiment of a configurable cushion assembly 100 adapted to support one or more personal pleasure devices 206 for men, wherein a cushion includes spaced apertures sized and shaped to receive a personal pleasure device for men;

FIG. 27 is a perspective view of another embodiment of a configurable cushion assembly according to the present invention;

FIG. 28 is a perspective view of an opposite side thereof;

FIG. 29 is an enlarged perspective view of a cushion insert showing gripping regions 400*a*, 400*b*, 400*c*, 400*d* within the cushion body;

FIG. 30 depicts an end view of the embodiment shown in FIGS. 27-28 where device reception openings 180 are indicated by brackets;

FIG. 31 is another enlarged perspective view of a cushion insert showing gripping regions 400*a*, 400*b*, 400*c*, 400*d* within the cushion body;

FIG. 32 is a perspective view thereof showing a standing configuration.

REFERENCE LISTING OF THE NAMED ELEMENTS

100 configurable cushion assembly
101 cushion cover
102 first cushion
104 second cushion
106 third cushion
108 fourth cushion
110 first cushion to second cushion pivoting connection
112 second cushion to third cushion pivoting connection
114 third cushion to fourth cushion pivoting connection
116 first cushion, first large face
118 first cushion, second large face
120 second cushion, first large face
122 second cushion, second large face
124 third cushion, first large face
126 third cushion, second large face
128 fourth cushion, first large face
130 fourth cushion, second large face
132 first cushion, sloping face
134 second cushion, sloping face
136 third cushion, sloping face
137 fourth cushion, sloping face
138 first cushion, joinable face
144 fourth cushion, joinable face
146 second cushion, joinable face
148 third cushion joinable face
150*a*, 150*b* first cushion outside faces
152*a*, 152*b* second cushion outside faces
154*a*, 154*b* third cushion outside faces
156*a*, 156*b* fourth cushion outside faces
160*a*, 160*b* first cushion base face
162*a*, 162*b* fourth cushion base face
168 connecting strap
169 air hole
170*a*, 170*b* second cushion base face
172*a*, 172*b* third cushion base face
173 clasping members
180 device reception opening
182*a* first docking port recess
182*b* second docking port recess
184*a* third docking port recess
184*b* fourth docking port recess
185 docking recess retention slot
186*a* docking port cover
186*b* docking port cover slot
188*a* retention clip
188*b* retention clip aperture
189 pocket
190*a* device retentive insert
190*b* device retentive clasp
191 device retentive adjustment slot
192 retentive insert detent
200, 202, 204, 206 personal pleasure device
208 cord
300 mount
400*a*, 400*b*, 400*c*, 400*d* gripping regions
402 gripping region retention slot

DETAILED DESCRIPTION OF THE EMBODIMENTS

In the following description, the terms "article for personal pleasure activities", "configurable cushion apparatus" and "configurable cushion assembly" may be used interchangeably. The term "cushion" refers to any portion of the configurable cushion assembly for personal pleasure activities which may perform the function of a cushion, that is, a pillow or pad with at least portions being soft to the touch. The term "insert" may refer to any item or article inserted onto or into a portion of the configurable cushion assembly for personal pleasure activities; especially when employed to retain or support a personal pleasure device in a desired position relative to the configurable cushion assembly. The term "stop" refers to an element that provides, alone or in combination with another element, a barrier to undesired movement of an object associated with the apparatus for personal pleasure activities. The term "mate" means certain faces of the cushions are configured to abut each other in various cushion assembly configurations, and in various embodiments attach and detach to and from one another in order to create a stable construction for the intended uses set forth in the disclosure. As used herein, the terms "personal massage device", "massaging device", "personal pleasure device", "personal sexual device" or even simply "personal device", may be used interchangeably, and may generally be used to refer to devices such as massaging devices, vibrators, dildos, sex toys, or any other device that may be used for health reasons or for providing personal pleasure to a user via contact of one or more pleasure or erogenous areas or zones of the user(s). In more specific embodiments, the erogenous areas comprise the genitals or anus of the user. Additionally, reference herein to "optimal" positioning of a device using a configurable cushion according to the disclosed principles means the positioning of a personal device in one or more positions that causes the device to contact a pleasure or erogenous area of the user or users in a hands-free manner, and thus without the need to hold the cushion or the device in a given position with the hands. With regard to particular drawing figure descriptions, directional or positional terms used to describe some elements; e.g., top, upper, lower, bottom, left, right are to be interpreted solely in reference to the instant drawing figure being described. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. Objects, aspects or features of any embodiment described herein may be combined with any object, aspect or feature of another embodiment described herein. The term "comprises" means "includes." All publications, patent applications, patents, and other references mentioned herein are incorporated by reference in their entirety for all purposes. In case of conflict, the present specification, including explanations of terms, will control.

In view of the foregoing, through one or more various aspects, embodiments and/or specific features or sub-components, the present disclosure is thus intended to set forth one or more of the advantages that will be evident from the description. The present disclosure makes references to one or more specific embodiments by way of illustration, and example. It is understood, therefore, that the terminology, examples, drawings, and embodiments are illustrative and are not intended to limit the scope of the disclosure.

Figure 1:
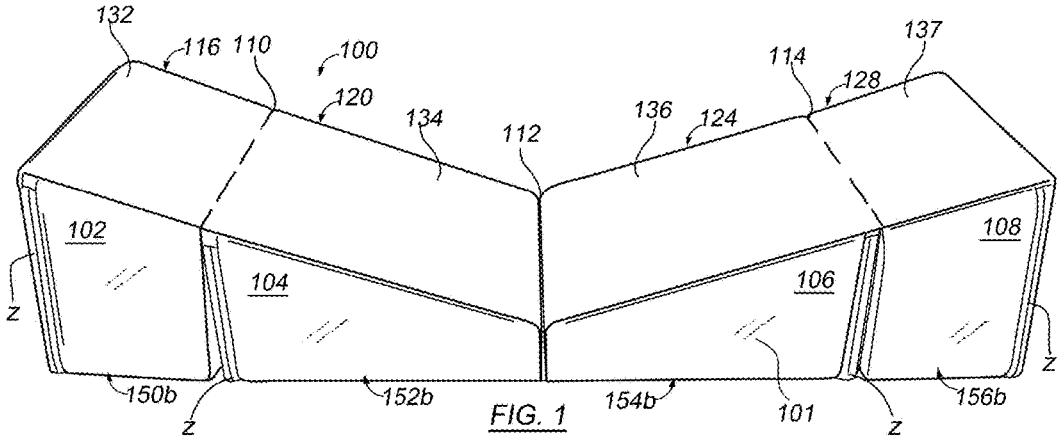
FIG. 1 is a perspective view of a first configuration of one embodiment for a configurable cushion assembly adaptable for personal pleasure activities, shown in a fully extended state.

Referring generally to FIGS. 1-32, various embodiments of an apparatus for personal pleasure activities includes a configurable cushion system 100. The configurable cushion assembly includes a plurality of pivotable cushion members 102, 104, 106 and 108. While in one general embodiment depicted, the number of cushions is four, it is conceivable that the number of cushions may vary as long as the disclosed functionality of the general embodiment is met. Referring more specifically to FIG. 1, for purposes of conciseness and clarity the cushions are numbered from left to right 102, 104, 106 and 108. Configurable cushion assembly 100 is bilaterally symmetrical. First cushion 102 and fourth cushion 108 are mirror images of each other, while second cushion 104 and third cushion 106 are mirror images of each other. The second and third cushions are typically larger than the first and fourth cushions. Furthermore, each cushion from left to right is joinable to an adjacent cushion by a pivoting connection 110, 112, 114 that may be in some embodiments, a portion of a fabric covering 101 of the cushion assembly 100 that permits each cushion; e.g., 102, 104, 106 and 108, to be pivotably or hingeably re-positioned with respect to an adjacent cushion and thereby capable of forming multiple cushion-to-cushion configurations/constructions. While in the embodiments depicted herein, each pivotable connection is a material strip of the fabric covering 101 of the configurable cushion assembly 100, it is conceivable that the cushions might be pivotably or hingeably connected, yet also detachable from one another by way of hook and loop material, buttons, ties or snaps that do not impede hinging or pivoting movement required to assume the various stable constructions set forth and suitable for the various uses set forth. Typically the pivoting connections of the cushions 110, 112 and 114 may hinge or pivot in more than one direction, where the extent of travel of any hinged cushion is limited by its abutting contact with an adjacent cushion. Cushions 102, 104, 106 and 108 are generally trapezoidal. The cushions have at least one subset of joinable faces 138, 144, 146 and 148 and the at least one subset of joinable faces is configured to mate with, join to or abut with at least one other member of the at least one subset of joinable faces when modified by the user. Two generally larger cushions, second cushion 104 and third cushion 106 each have a first large face 120, 124 that contains at least one docking port recess 182*a*, 182*b*, 184*a*, 184*b* that is shaped somewhat like a cove, or a trench, and wherein the at least one docking port recess is adapted to accept all or portions of a personal pleasure device 200. Note that while in the embodiments depicted herein, the personal pleasure device most generally depicted is the iconic Hitachi Magic Wand®, the disclosed invention is not to be limited to any one particular personal pleasure/massaging device. In various configurations the first large faces 120, 124 of the second and third cushions 104, 106 are configured to hingeably mate aligning pairs of oppositely positioned docking port recesses 182*a*, 182*b*, 184*a*, 184*b* in a clamshell arrangement, and thereby form one or more tunnels, also termed docking ports DP that surround a personal pleasure device retained therein. Accordingly, devices regardless of shape, retained in the one or more docking ports may be readily accessed by separating the two first large faces 120, 124 of the second 104 and third 106 cushions. When the first large faces of the second and third cushions are joined, and docking port recesses 182*a*, 182*b*, 184*a*, 184*b* are mated, external openings termed device reception openings 180 are also created at the hinge line between cushions 104, 106 that may permit some devices to be inserted directly into the docking ports when the cushions are mated. When a personal pleasure device is retained by the mated docking port recesses 182*a*, 182*b*, 184*a*, 184*b* portions of a personal pleasure device 200 may extend beyond the device reception openings 180 whereby a desired portion of the personal pleasure device 200 contained within the docking ports DP formed by the mated docking port recesses is exposed for pleasurable activity. Furthermore, it is intended that the device reception openings 180 may be wholly or partially hidden when the configurable cushion assembly is not configured to expose a personal pleasure device. The device reception openings 180 may be any shape; e.g., circular, oval, slots, slits, elastically gathered annuli, etc., that permit the exposure of portions of a personal pleasure device 200 being retained by the docking ports DP, and may depending on the configuration, not be readily visible. Accordingly, it is intended that the configurable cushion assembly 100 be discreet in appearance giving no obvious outward indication of intended use when not in use. The configurable cushion assembly may also be used for activities generally unrelated to personal pleasure or stimulation, such as a reclining cushion for reading, or a soft construction usable in various exercise and/or stretching activities, etc. In certain configurations, the configurable cushion assembly also permits discreet containment and "stowing away" of personal pleasure devices, the docking port recesses being sized and shaped to wholly encapsulate certain devices when desired. In the embodiments depicted, while the docking port recesses and resilient material overlaying the recesses prevent a retained personal device from inadvertent lateral movement, the configurable cushion assembly has various means for fixing the longitudinal position of a retained personal pleasure device that may include repositionable insertable clips termed retention clips 188*a*, that are transversely placed across a docking port DP that includes mating docking port recesses 182*a*, 182*b*, 184*a*, 184*b* forming the docking port DP, and wherein the docking port recesses may further include a device retentive insert 190*a* placed inside a docking port recess, or a resilient material overlaying the docking port recesses. The foregoing elements may work singly or cooperatively to form a barrier to prevent the personal pleasure device from undesirably descending into a docking port during use, and allows the docking ports DP to retain personal pleasure devices of various dimensions at a precise position including a fixed user determined depth, and provides a means to expose a desired portion or amount of the device for use. In various embodiments depicted herein repositionable clips 188*a* may slide into or mate with transversely spaced slots, stops, ridges, and detents according to the various embodiments 185, 186*b*, 191 in order to accommodate the repositionable clips. In some embodiments depicted herein, device depth settings are determined by the placement of one or more device retentive inserts 190*a* shaped and sized to be retained inside one or more of the recesses 182*a*, 182*b*, 184*a*, 184*b*. Each of the one or more device retentive inserts 190*a* is generally customized for a particular personal pleasure device and contains various integral ridges, detents, slots, latches, clasps 190*b* or other molded fixtures that may secure the personal pleasure device at a certain depth relative to a docking port DP. In some implementations, a device retentive insert may be fixed within one or more of the docking port recesses 182*a*, 182*b*, 184*a*, 184*b* at an adjustable position within the particular recess by a retention clip 188*a* transversely bisecting the device retentive insert 190*a* via one of stops/slots 191, and penetrating the cushion insert CI via one of the docking port recess retention slots 185. In some embodiments, a mateable pair of device retentive inserts 190*a* may form a clamshell case nested within mating recesses of the cushions 104, 106 that is customized to receive and surround at least portions of a personal pleasure device and to retain and secure same within the configurable cushion assembly 100. The one or more device retentive inserts 190*a* may include integral slots/stops 188*a* designed to accommodate a transversely placed clip 188*b* in a manner similar to other embodiments depicted herein. In yet other implementations, a resilient deformable material termed a docking port cover 186*a* having transverse slots termed docking port cover slots 186*b*, is placed over the docking port recesses such that the slots are aligned with docking port retention slots 185. In other words, a cavity belonging to a docking port recess may reside between the docking port covers and the docking port retention slots. Because the material of the docking port cover is resilient and deformable, it depresses when a personal pleasure device is placed thereagainst. Accordingly, those portions of the docking port covers directly abutting the device are pushed into the cavity thereby nesting the device into the recess, while those portions beyond the bounds of the personal pleasure device are unaffected and remain non-deformed and spanning the corresponding docking port recess. In this manner, retention clips 188*a* placed to the rear of a device and into docking port cover slots 186*b* form a barrier to prevent the device from undesired slipping within a formed docking port DP.

FIG. 1 is a perspective view of a first configuration of one embodiment for a configurable cushion assembly 100 adaptable for personal pleasure activities, shown in a fully extended state. FIG. 1 illustrates a "laying user" configuration of the configurable cushion assembly 100. In the laying user configuration the configurable cushion assembly 100 is laid out forming a low angle valley from the first cushion 102 to the fourth cushion 108. In this configuration, upwardly positioned faces of the cushions, designated as (first cushion, first large face 116), (second cushion, first large face 120), (third cushion, first large face 124) and (fourth cushion, first large face 128) form the low angle valley against which a user can rest in order to utilize his/her personal pleasure device, or provide a configuration conducive to multiple users. The laying user configuration is achieved by fully extending the configurable cushion assembly in a linear fashion as shown, where the first 102 and fourth 108 cushions are not contacting, are the most distal cushions relative to central pivoting connection 112, and, the first 102 and fourth cushion 108 are at opposite ends of the configuration. The laying user configuration, like all configurations described herein, can have medical uses such as providing a support pillow for those with back or hip problems. In the instant configuration, no docking ports DP or recesses 182*a*, 182*b*, 184*a*, 184*b* which form the docking ports are visible, being located on the opposite sides of second cushion 104 and third cushion 106.

Figure 2:
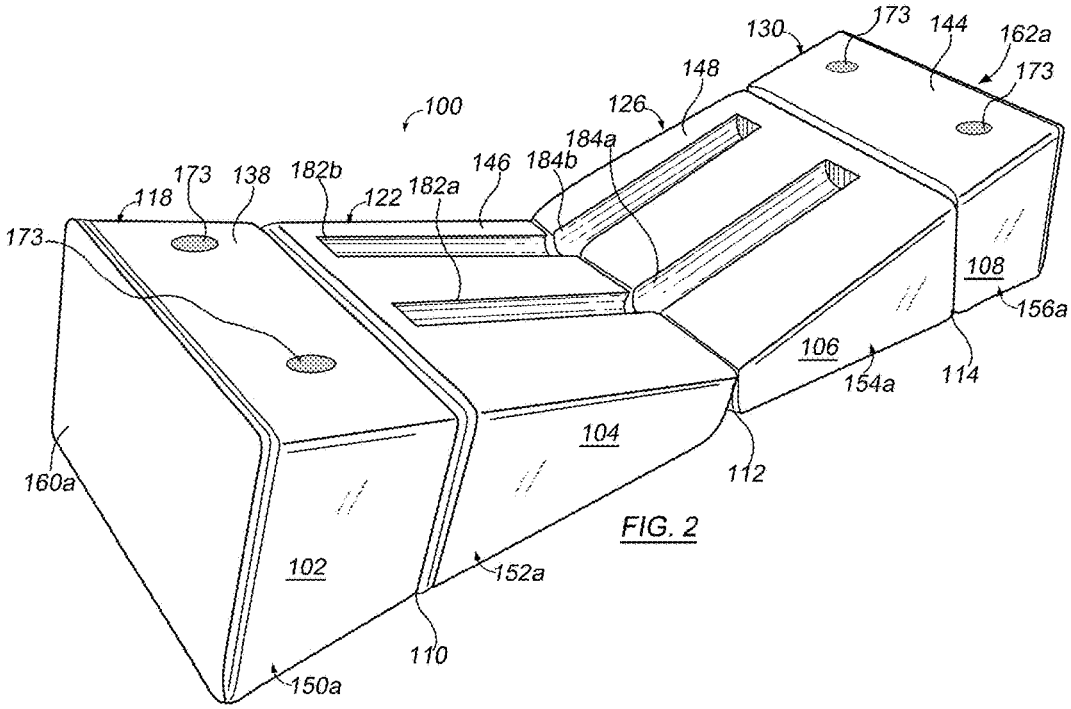
FIG. 2 is a perspective view thereof of a second configuration showing the opposite side of the assembly shown in FIG. 1.

FIG. 2 is a perspective view thereof of a second configuration showing the opposite side of the assembly shown in FIG. 1, and wherein mateable recesses 182*a*, 182*b*, 184*a*, 184*b* forming the docking ports DP are visible. Also shown are clasping members 173 which may be magnetic fasteners, hook and loop fasteners or other fastening means that will suggest itself to those having skill in the art and access to this disclosure suitable to join the face of first cushion 102 to the face of fourth cushion 108.

Figure 3:
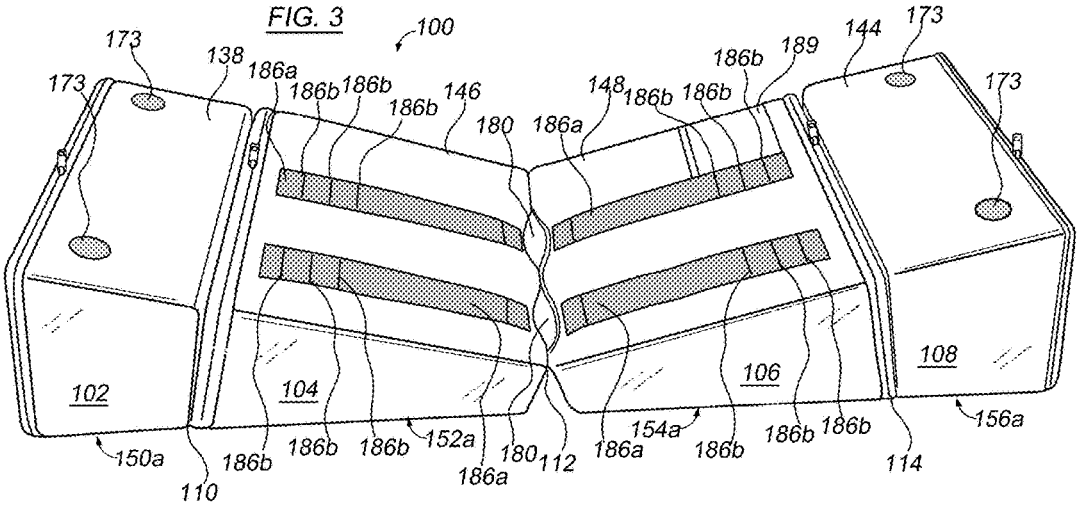
FIG. 3 is a perspective view thereof showing resilient material covers 186*a* over docking port recesses 182*a*, 182*b*, 184*a*, 184*b* (see FIG. 2)

FIG. 3 is a second perspective view of the side of the assembly shown in FIG. 2, however showing docking port covers 186*a* over recesses 182*a*, 182*b*, 184*a*, 184*b*. The docking port covers 186*a* include a reversibly deformable or yielding material such as elastic or nylon webbing that may depress into the recesses when the weight of an object is placed thereon. Multiple docking port cover slots 186*b* located transversely across the material coverings are adapted to receive a transversely placed retention clip 188*a* that penetrates into the recess, and into a slot(s) 185 (see FIG. 9) formed in a cushion insert CI of the configurable cushion assembly. Generally, when a personal pleasure device such as a personal pleasure device is placed atop the docking port covers 186*a*, it depresses the resilient deformable material such that the material conforms to the device. The material covering of the recesses may take the form of multiple strips of the resilient material placed end to end, the adjacent ends forming narrow openings defining the docking port cover slots 186*b*. Refer to FIG. 19 for one exemplary use of the docking port cover slots 186*b* and retention clips 188*a*.

Figure 4:
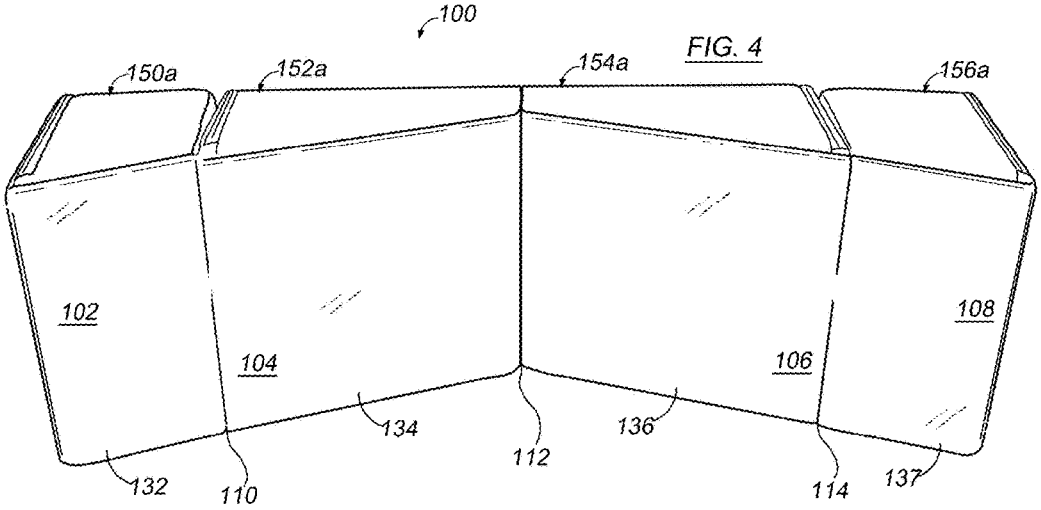
FIG. 4 is a perspective view of a third configuration showing the configurable cushion assembly fully extended on its side.

FIG. 4 is a perspective view showing the top of the cushion assembly while on its side in a fully extended state, also termed a "body pillow" configuration wherein the configurable cushion assembly 100 is placed on its side. The body pillow configuration provides no outward indication of the intended use of the configurable cushion assembly. A user may recline with the valley of the configurable cushion assembly.

FIG. 5 is a perspective view showing a standing configuration wherein the cushions are pivotably arranged to provide a tapering construction with a relatively wide, stable base and sloping sides. The particular configuration depicted allows a user to stand or squat over the configurable cushion assembly 100, or in the case of those users with long legs, allows the user to kneel over the configurable cushion assembly 100. For those users that cannot stand or kneel without support during physical activities such as sex, the configurable cushion assembly 100 in a standing position can provide support and a cushioned surface to rest against. Abutting faces of first cushion 102 and fourth cushion 108 are connected together through clasping members 173 which may be magnets, snaps or other clasping means as will be appreciated by those having skill in the art having access to this disclosure. In other embodiments there may also be straps 168, ties or ringlets that allow for other methods of connection to be used to secure the first cushion 102 and fourth cushion 108 together. Cushion cover 101 links all of the cushions 102, 104, 106 and 108 and provides soft hingeble connection points 110, 112, 114 which allow the cushions 102, 104, 106 and 108 to be pivotably arranged into various configurations. Zippered openings (z) allow the cushion inserts CI to be removed from the cushion cover 101. Note that while zippered openings are the preferred closure method to encapsulate the removable and launderable cushion inserts, other reversibly sealable openings; e.g., Ziplock® seals, snaps, buttons or ties, will suggest themselves to those having skill in the art having access to this disclosure.

Figure 6:
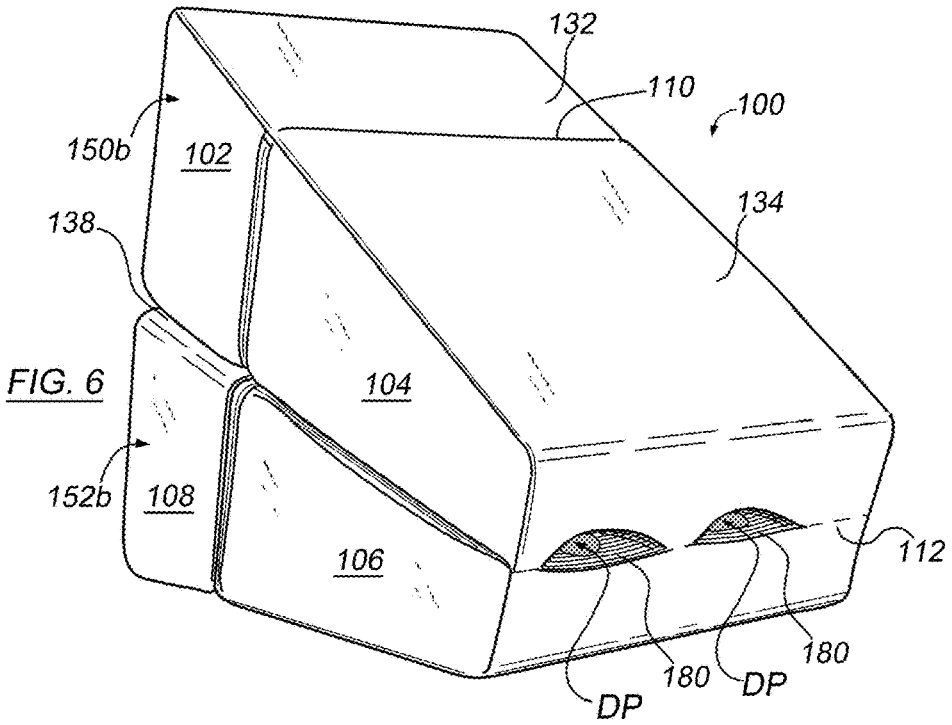
FIG. 6 is a perspective view thereof showing a fifth configuration wherein one of the sloping sides shown in FIG. 5 is placed on a level surface.

FIG. 6 is a perspective view thereof showing another configuration, also called the "face laying" configuration wherein one of the sloping sides of the second 104 or third cushion 106 shown in FIG. 5 is placed on a level surface. The face laying configuration allows the configurable cushion assembly 100 to be used with a user laying down on his/her back or side. In the face laying configuration the configurable cushion assembly 100 can be used as a support for a multitude of positions and uses, including but not limited to a user laying down with his/her chest or back resting on the configurable cushion assembly 100.

Figure 7:
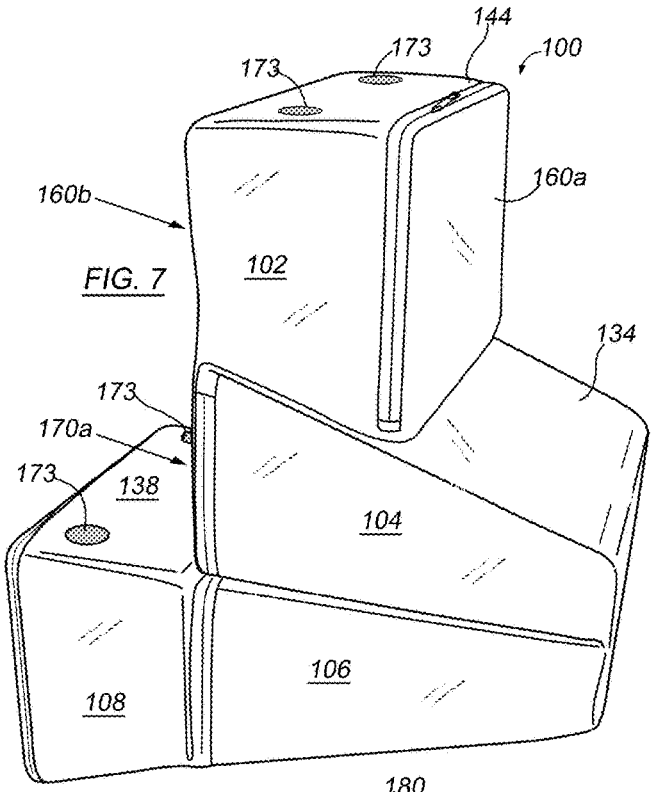
FIG. 7 is a perspective view thereof showing a sixth configuration also called a "resting shelf" wherein the previous configuration shown in FIG. 6 is altered by pivoting a cushion at connection 110.

FIG. 7 is a perspective view thereof showing the "resting shelf" configuration obtained from the previous configuration shown in FIG. 6 by pivoting first cushion 102 upwardly at pivoting connection 110. The resting shelf configuration of the configurable cushion assembly 100 is a combination of the face laying configuration and the kneeling saddle configuration (refer to FIG. 8). One angled face of the first cushion 102 is abutting a sloping face 134 of the second cushion 104. The second cushion 104 is abutting a face of the third cushion 106, and both the third cushion 106 and fourth cushion 108 are placed on a level surface. The resting shelf configuration permits a user to rest or kneel on the upwardly exposed face of the fourth cushion 108. Additionally, a user can also kneel or rest against the second cushion 104. This configuration is especially advantageous for pregnant persons who wish to support their belly and still engage is sexual activity with a partner. This is accomplished by resting the belly against face 138 and breasts atop cushion 102.

Figure 8:
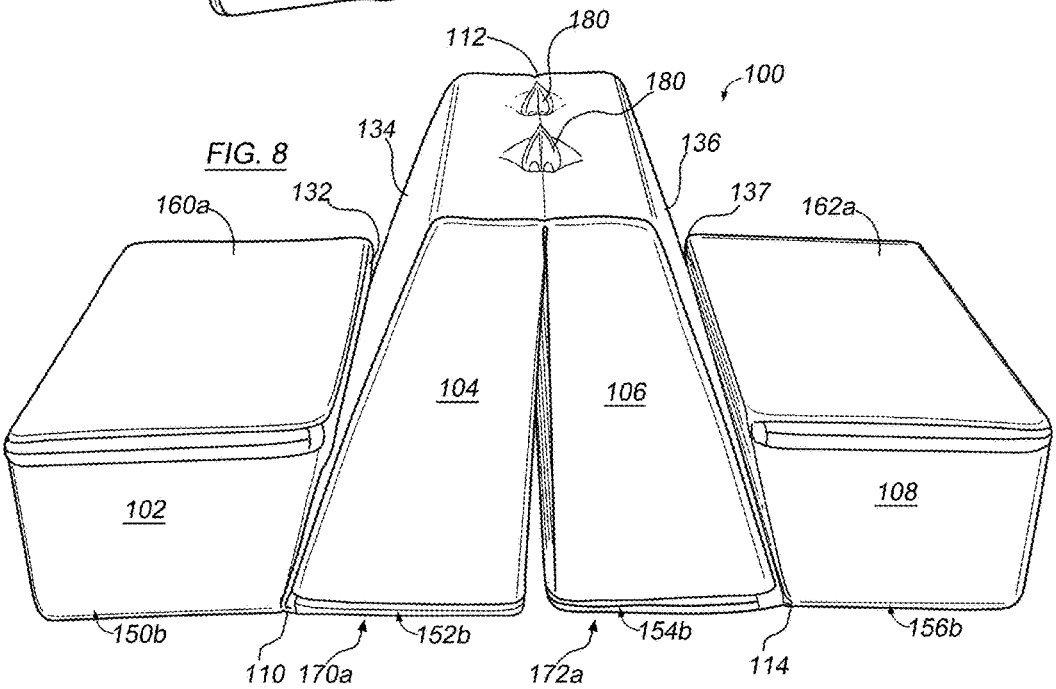
FIG. 8 is a perspective view thereof showing a seventh configuration also called "resting saddle" wherein both of the smaller cushions are pivoted such that the larger cushions are abutting and resting on their base, with device reception openings 180 facing upward.
Figure 9:
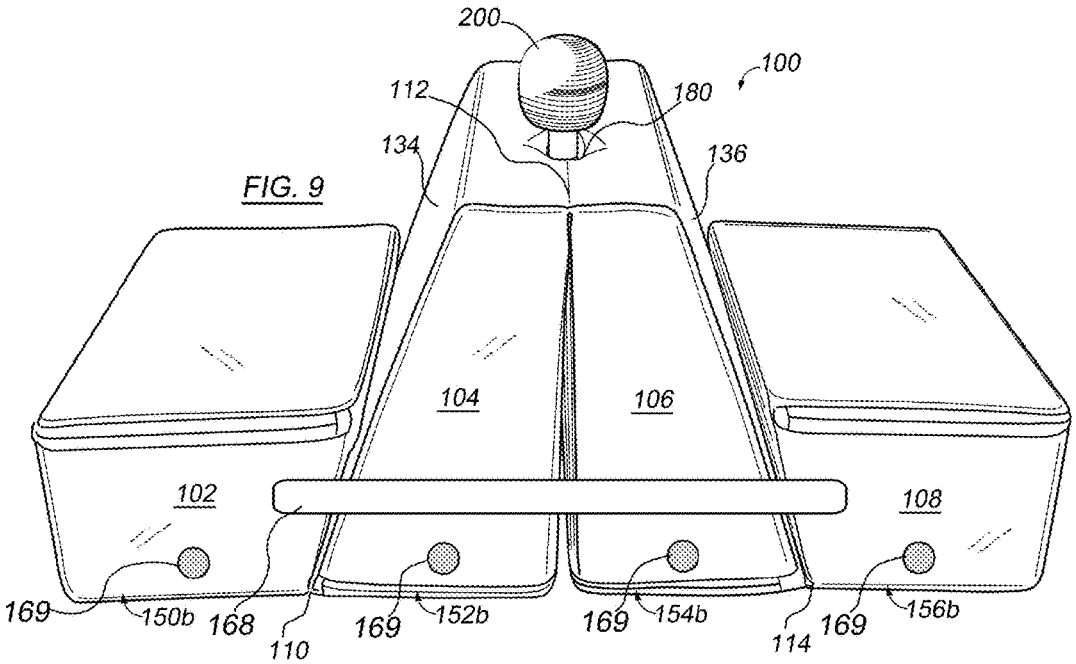
FIG. 9 shows another embodiment wherein the configurable cushion assembly is secured in position by one or more straps 168.
Figure 10:
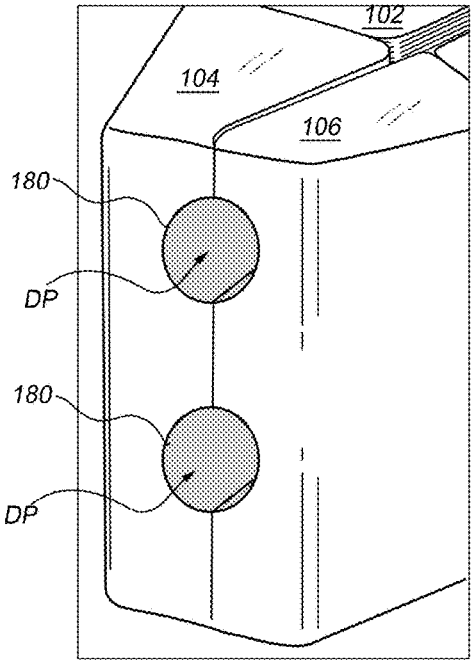
FIGS. 10 and 11 are perspective views thereof showing other configurations wherein the contracted cushion assembly is placed on a first non-sloping side and then a side opposite the first non-sloping side, providing varying spacing and heights for device reception openings 180.
Figure 11:
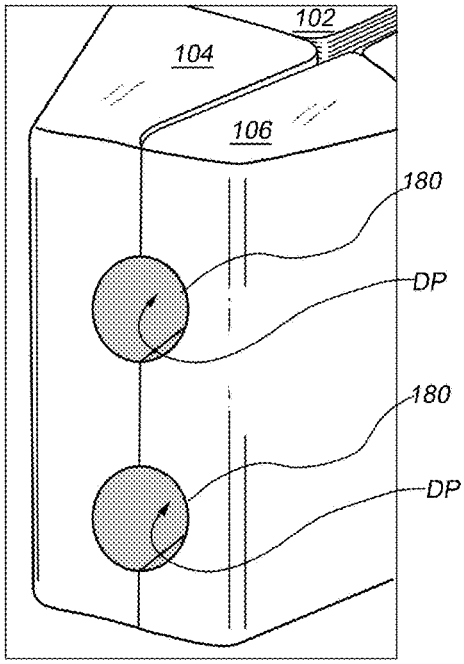
Figure 12:
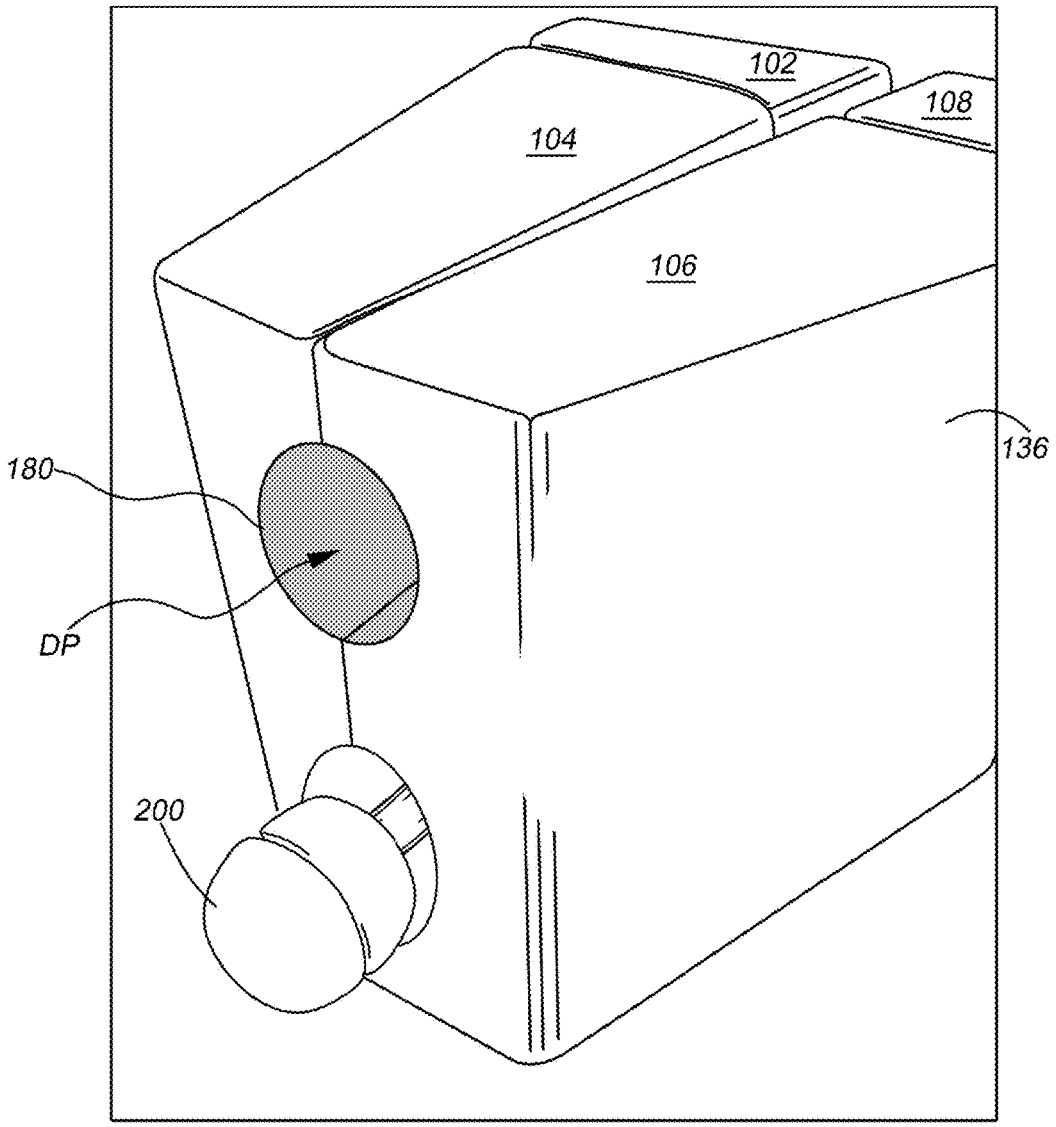
FIG. 12 is a perspective view of the configurations shown in FIGS. 10 and 11 wherein a personal pleasure device 200 has been retained within a mating pair of docking port recesses 182*a*, 182*b*, 184*a*, 184*b* (see FIG. 2), with a section of the personal pleasure device 200 extending from the cushions.

FIGS. 8 and 9 are perspective views thereof showing the "kneeling saddle" configuration obtained when the first cushion 102 and fourth cushion 108 are rotated via first pivoting connection 110, and third pivoting connection 114 resulting in a joinable face 146 of the second cushion 104 abutting a joinable face 148 of the third cushion 106, and, sloping face 132 of the first cushion 102 abutting sloping face 134 of the second cushion and the sloping face 137 of the fourth cushion abutting the sloping face 136 of the third cushion. In this configuration, the user can be kneeling over the upper support cushions; (here, the second cushion 104 and third cushion 106), with the user's thighs resting against the sloping faces 134, 136 respectively, of the second 104 and third 106 cushions with knees resting on the first 102 and fourth 108 cushions. The kneeling saddle configuration also allows a user to rest both his/her knees and his/her hands on the configurable cushion assembly 100, giving the user a more comfortable and enjoyable experience. In situations where multiple users may simultaneously use the cushion assembly, one or more users can rest on the first 102 and fourth 108 cushions, and/or the second 104 and third 106 cushions the second 104 and third 106 cushions. Connecting straps 168 can be used to provide a connection between the cushions 102, 104, 106, 108 to prevent cushions from shifting from the desired configuration and how air holes 169 can be used to prevent rupture of the material cover during use of the configurable cushion assembly 100 for physical pursuits FIGS. 10-12 are partial perspective views showing a configuration of a second embodiment for a configurable cushion assembly 100, that is obtained by rotating the configuration shown in FIG. 6 such that the vertical sides shown in FIG. 6 are facing up. Depending on which side the configurable cushion is placed, the device reception openings 180 are at varying distances from the floor or other surface on which the assembly is resting. One exemplary measurement places the center of the respective openings at 5 inches and 9.5 inches from the floor contacting edge of the assembly, and 2.5 inches and 7 inches from the floor contacting edge of the assembly. FIG. 12 shows a personal pleasure device extending from one device reception opening 180 of the instant configuration. The foregoing exemplary dimensions were determined to provide a user with the most anatomically correct positioning while maintaining comfort ability when employing the configurable cushion assembly 100 for hands-free use with a personal massaging device 200. For example, in one configuration a user can lay on his/her back, while in another configuration a user can be laying on his/her stomach, or perhaps even in a kneeling position in order to position a personal massage device in optimal locations for personal, pleasurable use by the user. Accordingly, a user may employ the configurable cushion assembly 100 with a massaging device in a hands-free manner, from any of a number of positions, while the configurable cushion 102 provides an optimal positioning of the device(s) for the user's selected position. It is not intended that the invention be limited to the forgoing measurements as alternative measurements and/or spacing will suggest itself to those having skill in the art and benefit of this disclosure.

FIG. 13 shows a "standing configuration" of the configurable cushion assembly 100 wherein a personal pleasure device 200 is shown retained in an upright position. One or more personal pleasure devices 200 may be placed in the one or more docking ports, either by insertion via the one more device reception openings 180 or placement in the one or more recesses forming docking ports 182*a*, 182*b*, 184*a* and 184*b* prior to configuring the assembly in the standing position. The standing configuration provides stability, anatomically correct positioning, ergonomic comfort and optimal and precise positioning for a personal pleasure or massaging device interacting with an erogenous area of a user.

The configurable cushion assembly 100 may further provide a "wedge" for a user to lie over. Specifically, for certain users, bending forward upon his/her knees during a sexual encounter may prove to be painful, especially for long periods of time. Accordingly, a user may lay the configurable cushion assembly 100 with a sloping side of the second cushion 104 or third cushion 106 face down (e.g., against the floor or bed surface), and place the lower support cushion bases against the tops of his/her thighs, and thus comfortably lay forward over the second and third cushions on his/her stomach. This not only allows the user a comfortable support for this bent and kneeling position, but the unique angular configuration of the four support cushions 102, 104, 106, 108 and permits an angle less than 90 degrees when measured from the tops of the thighs to the stomach of the user when in this bent position, providing an optimal position for sexual encounters that employ this position.

Consequently, users may use the configurable cushion assembly 100 in this manner to maintain this position over prolonged periods of time, and thus without suffering the undesirable fatigue of the user's back or wear on the user's knees that often occurs from positioning his/her body in this position.

FIGS. 14-17 are end views of the larger cushions 104, 106 showing a variety of device reception openings 180. The device reception openings 180 may take the form of visible apertures or apertures which are not readily visible and that may be circular, oval or slits. The apertures may be flared or non-flared at their openings. The apertures may include a flap cover. The apertures may have a gathered or non-elastically gathered opening. Visible apertures and/or apertures not readily visible may be used in combination or separately. The device reception openings may be made of the same material as the cushion cover 101 of the configurable cushion assembly 100, or, another material, as long as the functionality described herein is retained. Typically, the device reception openings 180 are formed when the docking port recesses 182*a*, 182*b*, 184*a* and 184*b* are mated in a clamshell configuration. When no material covers 186*a* are placed over the docking port recesses, the reception openings may open into the docking port DP formed by the recesses. When a material cover is placed over each of the respective docking port recesses, the device reception openings may open into a space separating the outside of the facing material covers. This permits the reception of personal pleasure devices of various shapes and sizes.

FIG. 18 shows a foam insert for one of two larger cushions 104, 106 of the configurable cushion assembly 100. On the side of the foam insert are recesses 182*a*, 182*b* that mate in a clamshell arrangement with corresponding recesses 184*a*, 184*b* on a mating cushion (not shown). Plural docking port retention stops 185 are shown as transverse slots. A retention clip 188*a* is shown transversely inserted into one of the docking port recesses which is a half section of a docking port DP. The docking port recesses may be of a shape and/or size to accommodate the storage of a personal massaging device wherein the device is completely contained within the configurable cushion assembly, with no portions of the personal massaging device showing externally.

FIG. 19 shows a enlarged detail view of one side of the configurable cushion assembly 100 wherein elastic, yieldable or deformable covers 186*a* cover over docking port recesses 182*a*, 182*b*, 184*a*, 184*b*. Clips 188*a* are inserted transversely into slots 186*b* relative to the docking port recesses to serve as positive depth adjustment and stop. The clips have a central aperture 188*b* that permits the passing through of a cord of a personal pleasure device. The particular form of the clips 188*a* shown is merely exemplary. This disclosure is intended to encompass clips or depth stops of various configurations that transversely bridge the formed channel defined by the mating recesses of the docking ports 182*a*, 182*b*, 184*a*, 184*b*.

FIG. 20 is a perspective view thereof showing a side of the configurable cushion assembly 100, having pleasure devices 200 placed in longitudinal docking port recesses 182*a*, 182*b*, 184*a*, 184*b* of docking ports DP and with clips 188*a* engaged with docking port cover slots 186*b* in order to keep the respective devices from undesirable sinking into the docking ports DP.

FIG. 21 is another perspective view showing a side of the configurable cushion assembly 100, having a personal pleasure device 202 placed in a pleasure device docking port recess 182*a*, 182*b*, 184*a*, 184*b* of a docking port DP and wherein a clip 188*a* engages with one of the docking port cover slots 186*b* to keep the device suitably projecting from the device reception opening 180 as shown in FIG. 22, and to prevent the device from undesirable plunging into the docking ports DP.

FIG. 23 is a perspective view of a device retentive insert 190*a* with a curved profile for nesting placement into one of the docking port recesses 182*a*, 182*b*, 184*a*, 184*b*. The device retentive insert may be shaped and sized for a particular device, or a range of devices in order to prevent the device from slipping within the docking port DP after securement. The device retentive insert 190*a* allows for the retention and positional fixing of various personal massaging device shapes within the docking port, while also protecting any attachment or power connections to the device, and permitting adjustment of various personal massaging device shapes with respect to the configurable cushion assembly 100, and maintaining an adjusted position while in use. The device retentive insert may include one or more device retentive adjustment slots 191 to accommodate various devices with wide bases or portions that require a particular exposure length/width beyond the exterior of the configurable cushion assembly 100 and to prevent the personal massaging device from slipping deeper into the device retaining docking port DP than desired. The device retentive insert 190*a* may include a clasping mechanism 190*b* which may be a clamp or latch as shown, allowing the personal massaging device 200 to be temporarily or semi-permanently attached to the device retentive insert 190*a* and prevent undesired slippage during device use. The device retentive insert may include one or more detents 192 which may include spring loaded buttons, depressable ridges, or other type of mechanical stop that prevents a retained device from unwanted movement within the one or more docking ports. As explained previously, the device retentive insert may be used in pairs which may attach together and surround a retained device in a clamshell configuration. Retention elements of the device retentive insert 190*a* used singly or in combination may prevent a device from slipping deeper into a docking port DP, prevent the device from slipping free of the device reception openings 180, or perform both functions.

FIG. 24*a* shows placement of the device retentive insert 190*a* of (FIG. 23) in one of the docking port recesses 182*a*, 182*b*, 184*a*, 184*b* of a cushion insert CI to illustrate how the insert nests in the recess. While typically, the insert would fit over the docking port recess and atop the exterior covering of the configurable cushion assembly, in cases where there are no docking port covers 186*a*, it may be that customized device retentive inserts contoured for particular devices would be inserted along with the cushion, and beneath the cushion cover 101. FIG. 24*b* is a perspective view of the top of a cushion insert CI with insert 190*a* placed into recess 182*b*. The particular recesses shown have a flaring portion 180*a* which is configured to nest the head of an Hitachi Magic Wand® (refer to FIG. 12 or 13) in order that the entire device may be stored and hidden by the configurable cushion assembly 100.

FIGS. 25A-25B illustrate alternative views of a flexible rubber mount 300 for fitment to a personal pleasure device 204 that enables a mounting portion of the personal pleasure device to fit into a device receptive opening 180 and remain retained therein during use. The mount shown which is in the form of an elastomeric cuff or cup is merely exemplary, having one end adapted to fit into opening 180 and the an opposite end adapted to fit to a personal pleasure device. Other mounts of various configurations will be appreciated by those skilled in the art and having access to this disclosure.

FIG. 26 illustrates an alternative embodiment of a configurable cushion assembly 100 adapted to support a personal pleasure device 206 for men, wherein a cushion has variously spaced openings sized and shaped to receive a personal pleasure device for men. The device reception openings 180 may be shaped and sized to hold a personal pleasure device for men without the need for a mounting element. The personal pleasure device depicted is the popular Fleshlight® which has a handle which may serve as a mounting portion for insertion into or retention by one or more device reception openings 180 and docking ports DP. Use of such an embodiment may also be helpful in decreasing the transmission of sexually transmitted diseases.

FIGS. 27 and 28 are perspective views depicting the top and bottom sides of another embodiment of the configurable cushion assembly that includes gripping regions 400*a*, 400*b*, 400*c*, 400*d* that are depicted corresponding in placement to the docking port recesses 182*a*, 182*b*, 184*a*, 184*b* of embodiments previously described. The gripping regions may include an elastomeric material, the purpose of which is to compressively and reversibly deform around the shape of a personal pleasure device that is held between mating docking port recesses. The resilient fill material may also include a viscoelastic foam capable of deforming around the perimeter of a personal pleasure device when compressed between the mating gripping regions. The size and shape of the gripping regions shown is merely exemplary. The elastomeric or viscoelastic material of the gripping regions may fit into or fill one or more cavities defined by the docking port recesses, or the elastomeric or viscoelastic material of the gripping regions may be surrounded by a body comprised of non-viscoelastic materials, or a layer of viscoelastic foam or elastomeric material may substantially cover the sloping sides 146,148 of the configurable cushion assembly 100. In any case, when the mating sides 146, 148 of the configurable cushion assembly are brought together around a personal pleasure device, the gripping regions compress around the shape of the device in a substantially gapless manner such that the device is held fast as long as the mating sides are held together.

FIG. 29 is a perspective view of a cushion insert showing gripping regions 400*a*, 400*b* comprising an elastomeric or viscoelastic material that correspond in placement to the docking port recesses 182*a*, 182*b*, 184*a*, 184*b* of embodiments previously described. The fill material of the gripping regions may be transversely divided into multiple adjoining sections having slots 402 therebetween for the reception of a retention clip 188*a*.

FIG. 30 depicts an end view of the embodiment shown in FIGS. 27-28 where the device reception openings 180 are indicated by brackets;

FIG. 31 is a perspective view of a cushion insert showing gripping regions 400*a*, 400*b* but without transverse slots. The gripping regions include a viscoelastic material that conforms very closely around the shape of an object pressed into the material such as personal pleasure device 200 which is shown being pressed into a gripping region in the direction of arrow (c). When a device is pressed between two gripping regions it resists longitudinal or lateral movement.

FIG. 32 shows a configurable cushion assembly 100 laying on its side that uses a strap 168 on both sides of the assembly to maintain the particular configuration, and keep the sloping faces 146,148 of the assembly around the retained device. The dashed lines represent mating gripping regions 400*a*, 400*c* and 400*b*, 400*d* that include a viscoelastic material that conforms closely about a held object. In this particular embodiment, the device reception openings 180, although present, are not visually discernible from the hinge line.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. An apparatus for personal pleasure activities comprising:

a configurable assembly of plural cushions pivotally connected along a hinge line including mateable faces; at least two of the mateable faces share at least one pair of mateable recesses, each recess of the at least one pair of mateable recesses includes a trenched portion and a border contiguous with the mateable faces adjacent the trenched portion, the recesses of the at least one pair of mateable recesses are configured to unite in a clamshell configuration when the borders contiguous with the at least two mateable faces are such that the at least one pair of mateable recesses defines at least one channel having a reception opening at the hinge line which is configured to receive, support and secure at least one personal pleasure device.

2. The apparatus according to claim 1 wherein the plural cushions are pivotably connected.

3. The apparatus for personal pleasure activities according to claim 1, wherein the configurable assembly is height adjustable.

4. The apparatus for personal pleasure activities according to claim 1, wherein the at least one channel has an opening adapted to expose portions of the at least one personal pleasure device.

5. The apparatus for personal pleasure activities according to claim 1, wherein each cushion of the plural cushions is separated from an adjacent cushion by a flexible connection.

6. The apparatus for personal pleasure activities according to claim 1, wherein the configurable assembly adapted to support the personal pleasure device in multiple fixed positions.

7. The apparatus for personal pleasure activities according to claim 1, further comprising at least one depth adjustment member for securing the at least one personal pleasure device in a fixed position.

8. The apparatus for personal pleasure activities according to claim 1, configurable to a position where at least four mateable faces are mated.

9. The apparatus for personal pleasure activities according to claim 1, configurable to a position where at least six mateable faces are mated.

10. The apparatus for personal pleasure activities according to claim 1, configurable to expose or hide the at least one pair of mating recesses.

11. The apparatus for personal pleasure activities according to claim 1, having a protective cord path for any cords extending from the at least one personal pleasure device.

12. An apparatus for personal pleasure activities comprising:

a configurable assembly of plural cushions pivotally connected along a hinge line with plural mateable faces; at least one resilient gripping region on at least two of the plural mateable faces, the gripping regions including a trenched portion and a border surrounding the trenched portion configured to mateably align in a clamshell configuration such that the at least two mateable faces define at least one channel having a reception opening at the hinge line and the gripping regions deform around contours of a personal pleasure device when the personal pleasure device is placed between the resilient gripping regions, and the gripping regions further configured to form a substantially gapless gripping surround around portions of the personal pleasure device configured to prevent movement of the personal pleasure device secured between the mateable faces.

13. The apparatus according to claim 12 further comprising an elastomeric material in the gripping regions.

14. The apparatus according to claim 12 further comprising at least one cushion position securing member.

15. The apparatus according to claim 12 further comprising pivotable connections between each cushion of the plural cushions.

* * * * *